US009511916B2

(12) United States Patent
Holley, Jr.

(10) Patent No.: US 9,511,916 B2
(45) **Date of Patent: *Dec. 6, 2016**

(54) PACKAGE FOR CONTAINERS

(71) Applicant: Graphic Packaging International, Inc., Atlanta, GA (US)

(72) Inventor: John Murdick Holley, Jr., Lawrenceville, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/731,448

(22) Filed: Jun. 5, 2015

(65) Prior Publication Data

US 2015/0266641 A1 Sep. 24, 2015

Related U.S. Application Data

(62) Division of application No. 14/103,097, filed on Dec. 11, 2013, now Pat. No. 9,079,699, which is a division (Continued)

(51) Int. Cl.
*B65D 75/42* (2006.01)
*B65D 71/42* (2006.01)

(Continued)

(52) U.S. Cl.
CPC ..... *B65D 71/42* (2013.01); *B65D 5/42* (2013.01); *B65D 71/40* (2013.01); *B65D 71/46* (2013.01);

(Continued)

(58) Field of Classification Search
CPC ..... B65B 5/024; B65D 71/40; B65D 71/42; B65D 71/46; B65D 75/02; B65D 85/00; B65D 2571/00277; B65D 2571/00444; B65D 2571/0066; B65D 2571/00802; B66C 1/10

(Continued)

(56) References Cited

U.S. PATENT DOCUMENTS 1,527,399 A 2/1925 Davidson
1,925,102 A 9/1933 Levkoff (Continued)

FOREIGN PATENT DOCUMENTS

CA 873185 A1 6/1971
DE 1 804 117 4/1970

(Continued)

OTHER PUBLICATIONS

Notification of the First Office Actin for Chinese Application No. 201180058088.7 dated May 5, 2014 and English translation.

(Continued)

*Primary Examiner* — Bryon Gehman
(74) *Attorney, Agent, or Firm* — Womble Carlyle Sandridge & Rice, LLP

(57) ABSTRACT

A carrier comprising a top panel, a first side panel foldably connected to the top panel, a second side panel foldably connected to the top panel, a first bottom panel connected to the first side panel by at least one first strut, and a second bottom panel connected to the second side panel by at least one second strut. At least one container-receiving portion can comprise a first retaining feature and an opposing second retaining feature. At least a portion of the first retaining feature or the second retaining feature is disposed in the first side panel or the second side panel. A container can be retained by at least one of the first retaining feature and the second retaining feature. At least a portion of at least one of the first bottom panel and the second bottom panel is disposed between the container and the top panel.

40 Claims, 21 Drawing Sheets

Related U.S. Application Data of application No. 13/309,927, filed on Dec. 2, 2011, now Pat. No. 8,631,932.

(60) Provisional application No. 61/458,931, filed on Dec. 3, 2010.

(51) Int. Cl.
*B65D 71/46* (2006.01)
*B65D 71/40* (2006.01)
*B65D 5/42* (2006.01)

(52) U.S. Cl.
CPC ..... *B65D 2571/0066* (2013.01); *B65D 2571/00271* (2013.01); *B65D 2571/00277* (2013.01); *B65D 2571/00444* (2013.01); *B65D 2571/00802* (2013.01)

(58) Field of Classification Search
USPC ..... 206/147–149, 151–153, 155–160, 427, 206/429, 434; 229/103.2; 294/87.2, 87.28; 493/84, 162
See application file for complete search history.

(56) References Cited

U.S. PATENT DOCUMENTS 2,005,924 A 6/1935 Wilson
2,067,749 A 1/1937 Zimmerman et al.
2,115,673 A 4/1938 Stompe
2,289,859 A 7/1942 Arthur
2,299,027 A 10/1942 Novak
2,331,038 A 10/1943 Meller
2,522,950 A 9/1950 Keith
2,669,351 A 2/1954 Carson et al.
2,754,047 A 7/1956 Schmidt et al.
2,798,603 A 7/1957 Grinspoon
2,950,041 A 8/1960 Stone
3,005,654 A 10/1961 Stone et al.
3,075,799 A 1/1963 Weiss
3,078,032 A 2/1963 Robinson et al.
3,128,010 A 4/1964 Forrer
3,133,634 A 5/1964 Bozdar
3,137,109 A 6/1964 Rapata
3,156,358 A 11/1964 Randrup
3,175,682 A 3/1965 Forrer
3,178,242 A 4/1965 Ellis et al.
3,228,582 A 1/1966 Osberg
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,363,928 A 1/1968 Haufe et al.
3,414,313 A 12/1968 Schwarz
3,503,498 A 3/1970 Lawrence
3,517,858 A 6/1970 Farquhar
3,528,697 A 9/1970 Wood
3,533,549 A 10/1970 Gilchrist
3,540,581 A 11/1970 Koolnis
3,601,439 A 8/1971 Poupitch
3,627,121 A 12/1971 Deasy
3,653,503 A 4/1972 Arneson
3,701,416 A 10/1972 Lawrence
3,722,945 A 3/1973 Wood
3,752,305 A 8/1973 Heyne
3,897,873 A 8/1975 Graser
3,942,631 A 3/1976 Sutherland et al.
4,029,204 A 6/1977 Manizza
4,155,449 A 5/1979 Bryne
4,192,540 A 3/1980 Oliff
4,214,660 A 7/1980 Hunt, Jr.
4,216,861 A 8/1980 Oliff
4,222,485 A 9/1980 Focke
4,256,226 A 3/1981 Stone
4,272,010 A 6/1981 Capo
4,304,329 A 12/1981 Graser
4,305,500 A 12/1981 Jaeschke
4,318,474 A 3/1982 Hasegawa
4,326,628 A 4/1982 Wood
4,336,898 A 6/1982 Joyce
4,364,509 A 12/1982 Holley, Jr. et al.
4,372,599 A 2/1983 Kiedaisch et al.
4,375,258 A 3/1983 Crayne et al.
4,376,509 A 3/1983 Schaffer
4,378,877 A 4/1983 Botterman et al.
4,378,879 A 4/1983 Killy
4,382,505 A 5/1983 Sutherland et al.
4,396,143 A 8/1983 Killy
4,398,636 A 8/1983 Baxter
4,417,655 A 11/1983 Forbes, Jr.
4,417,661 A 11/1983 Roccaforte
4,566,591 A 1/1986 Turtschan et al.
4,577,762 A 3/1986 Kuchenbecker
4,605,128 A 8/1986 Rieke
4,658,984 A 4/1987 Brunner
4,703,847 A 11/1987 Oliff
4,784,266 A 11/1988 Chaussadas
4,807,751 A 2/1989 Klygis et al.
4,817,866 A 4/1989 Wonnacott
4,890,440 A 1/1990 Romagnoli
4,949,845 A 8/1990 Dixon
4,974,771 A 12/1990 Lavery
5,101,642 A 4/1992 Alexandrov
5,103,971 A 4/1992 Schuster
5,137,211 A 8/1992 Summer et al.
5,139,147 A 8/1992 Sutherland
5,163,548 A 11/1992 Domansky
5,188,225 A 2/1993 Jorba
5,188,226 A * 2/1993 Platt ..... B65D 71/42 206/152
5,201,412 A 4/1993 Schuster et al.
5,219,229 A 6/1993 Sengewald
5,234,103 A 8/1993 Schuster
5,246,113 A 9/1993 Schuster
5,249,681 A 10/1993 Miller
5,267,644 A 12/1993 Tsao
5,297,673 A 3/1994 Sutherland
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,474 A 6/1995 Dalea et al.
5,443,153 A 8/1995 Sutherland
5,445,262 A 8/1995 Sutherland
5,452,799 A 9/1995 Sutherland
5,476,170 A 12/1995 Weber
5,482,185 A 1/1996 McNaughton
5,484,059 A 1/1996 Sutherland
5,503,267 A 4/1996 Sutherland
5,505,372 A 4/1996 Edson et al.
5,520,283 A 5/1996 Sutherland
5,524,756 A 6/1996 Sutherland
5,551,566 A 9/1996 Sutherland
5,553,705 A 9/1996 Bakx
5,577,612 A 11/1996 Chesson et al.
5,593,027 A 1/1997 Sutherland
5,597,114 A 1/1997 Kramedjian et al.
5,620,094 A 4/1997 Naumann
5,622,309 A 4/1997 Matsuda et al.
5,664,683 A 9/1997 Brody
5,667,070 A 9/1997 Miret
5,687,838 A 11/1997 Bakx
5,690,213 A 11/1997 Matsumura

(56) References Cited

U.S. PATENT DOCUMENTS

| | | | |
|---|---|---|---|
| 5,690,230 | A | 11/1997 | Griffith |
| 5,706,936 | A | 1/1998 | Bernstein |
| 5,711,419 | A | 1/1998 | Beales et al. |
| 5,746,310 | A | 5/1998 | Slomski |
| 5,791,463 | A | 8/1998 | Negelen |
| 5,794,778 | A | 8/1998 | Harris |
| 5,816,391 | A | 10/1998 | Harris |
| 5,820,185 | A | 10/1998 | Gomes |
| 5,826,783 | A | 10/1998 | Stout |
| 5,875,961 | A | 3/1999 | Stone et al. |
| 5,881,884 | A | 3/1999 | Podosek |
| 5,921,392 | A | 7/1999 | Davis |
| 5,921,398 | A | 7/1999 | Carroll |
| 5,924,559 | A | 7/1999 | Carrel et al. |
| 5,927,498 | A | 7/1999 | Saam |
| 5,960,945 | A | 10/1999 | Sutherland |
| 6,039,181 | A | 3/2000 | Whiteside |
| 6,050,402 | A | 4/2000 | Walter |
| 6,059,099 | A | 5/2000 | Galbierz |
| 6,176,419 | B1 | 1/2001 | Holley, Jr. |
| 6,223,892 | B1 | 5/2001 | Bakx |
| 6,241,083 | B1 | 6/2001 | Harrelson |
| 6,283,293 | B1 | 9/2001 | Lingamfelter |
| 6,315,111 | B1 | 11/2001 | Sutherland |
| 6,394,272 | B1 | 5/2002 | Domansky |
| 6,409,077 | B1 | 6/2002 | Telesca et al. |
| D459,927 | S | 7/2002 | Flowers et al. |
| 6,478,219 | B1 | 11/2002 | Holley, Jr. |
| 6,484,903 | B2 | 11/2002 | Spivey et al. |
| 6,488,322 | B2 | 12/2002 | Bakx |
| 6,550,615 | B2 | 4/2003 | Lingamfelter |
| 6,557,699 | B1 | 5/2003 | Focke et al. |
| 6,578,736 | B2 | 6/2003 | Spivey |
| 6,604,677 | B1 | 8/2003 | Sutherland et al. |
| 6,669,083 | B2 | 12/2003 | Bates |
| 6,715,639 | B2 | 4/2004 | Spivey |
| 6,752,262 | B1 | 6/2004 | Boriani et al. |
| 6,789,673 | B2 | 9/2004 | Lingamfelter |
| 6,866,186 | B2 | 3/2005 | Fogle et al. |
| 6,866,188 | B2 | 3/2005 | Harrelson |
| 6,896,130 | B2 | 5/2005 | Theelen |
| 6,902,104 | B2 | 6/2005 | Holley, Jr. et al. |
| 6,918,487 | B2 | 7/2005 | Harrelson |
| 6,929,172 | B2 | 8/2005 | Bates et al. |
| 6,945,450 | B2 | 9/2005 | Rusnock |
| 6,968,992 | B2 | 11/2005 | Schuster |
| 6,969,172 | B2 | 11/2005 | Actis-Datta |
| 6,974,072 | B2 | 12/2005 | Harrelson |
| 6,991,107 | B2 | 1/2006 | Harrelson |
| 6,997,316 | B2 | 2/2006 | Sutherland |
| 7,000,803 | B2 | 2/2006 | Miller |
| 7,011,209 | B2 | 3/2006 | Sutherland et al. |
| 7,083,046 | B2 | 8/2006 | Bakx |
| 7,104,435 | B2 | 9/2006 | Holley, Jr. |
| 7,134,593 | B2 | 11/2006 | Harrelson |
| 7,163,103 | B2 | 1/2007 | Bakx et al. |
| 7,168,558 | B2 | 1/2007 | Harrelson |
| 7,225,930 | B2 | 6/2007 | Ford et al. |
| 7,240,789 | B2 | 7/2007 | Sutherland |
| 7,264,114 | B2 | 9/2007 | Daniel |
| 7,374,038 | B2 | 5/2008 | Smalley |
| 7,690,507 | B2 | 4/2010 | Sutherland |
| 7,721,878 | B2 | 5/2010 | Requena |
| 7,789,231 | B2 | 9/2010 | Requena |
| 7,823,721 | B2 | 11/2010 | Sutherland |
| 8,056,709 | B2 | 11/2011 | Sutherland |
| 8,061,519 | B2 | 11/2011 | Taglione |
| 8,096,413 | B2 | 1/2012 | DePaula |
| 8,162,135 | B2 | 4/2012 | Oliveira |
| 8,631,932 | B2 | 1/2014 | Holley, Jr. |
| 9,079,699 | B2 | 7/2015 | Holley, Jr. |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2002/0195371 | A1 | 12/2002 | Brown |
| 2003/0080004 | A1 | 5/2003 | Olsen et al. |
| 2003/0141313 | A1 | 7/2003 | Bates |
| 2003/0150759 | A1 | 8/2003 | White, Jr. |
| 2003/0192907 | A1 | 10/2003 | Bates |
| 2003/0213705 | A1 | 11/2003 | Woog |
| 2004/0011674 | A1 | 1/2004 | Theelen |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0226833 | A1 | 11/2004 | Daniel |
| 2005/0023170 | A1 | 2/2005 | Lingamfelter |
| 2005/0092820 | A1 | 5/2005 | Chekroune |
| 2005/0103650 | A1 | 5/2005 | Auclair et al. |
| 2005/0126947 | A1 | 6/2005 | Holley, Jr. |
| 2005/0127151 | A1 | 6/2005 | Johnson |
| 2005/0178791 | A1 | 8/2005 | Miller |
| 2005/0189405 | A1 | 9/2005 | Gomes et al. |
| 2005/0224565 | A1 | 10/2005 | Holley |
| 2006/0054522 | A1 | 3/2006 | Kline et al. |
| 2006/0091193 | A1 | 5/2006 | DeBusk |
| 2006/0118606 | A1 | 6/2006 | Holley, Jr. et al. |
| 2006/0131370 | A1 | 6/2006 | Bates |
| 2006/0175386 | A1 | 8/2006 | Holley, Jr. |
| 2008/0121536 | A1 | 5/2008 | Miret |
| 2008/0135423 | A1 | 6/2008 | Oliveira |
| 2009/0101526 | A1 | 4/2009 | Sutherland et al. |
| 2009/0127147 | A1 | 5/2009 | Sutherland |
| 2010/0264043 | A1 | 10/2010 | De Paula |
| 2011/0000799 | A1 | 1/2011 | Gonzalez |
| 2011/0284623 | A1 | 11/2011 | Jones et al. |
| 2012/0080328 | A1 | 4/2012 | DePaula |
| 2012/0138489 | A1 | 6/2012 | Holley, Jr. |
| 2012/0285854 | A1 | 11/2012 | Spivey, Sr. |

FOREIGN PATENT DOCUMENTS

| | | | |
|---|---|---|---|
| DE | 202 13 450 | U1 | 11/2002 |
| EP | 0 066 029 | A1 | 12/1992 |
| EP | 0 636 554 | A2 | 2/1995 |
| EP | 0 806 372 | | 6/1997 |
| EP | 1 384 679 | A1 | 1/2004 |
| FR | 2 549 010 | | 1/1985 |
| GB | 1 237 216 | | 6/1971 |
| GB | 2 264 101 | A | 8/1993 |
| JP | 5-84660 | | 11/1993 |
| JP | 2003-146359 | | 5/2003 |
| JP | 2003-341718 | | 12/2003 |
| JP | 2005-153914 | | 6/2005 |
| JP | 2010-534597 | | 11/2010 |
| WO | WO 93/25439 | A1 | 12/1993 |
| WO | WO 96/29260 | | 9/1996 |
| WO | WO 98/49071 | A1 | 11/1998 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | A1 | 6/2005 |
| WO | WO 2006/050210 | A2 | 5/2006 |
| WO | WO 2006/050316 | A1 | 5/2006 |
| WO | WO 2007/089844 | A1 | 8/2007 |
| WO | WO 2009/015320 | A3 | 1/2009 |
| WO | WO 2012/075374 | A2 | 6/2012 |

OTHER PUBLICATIONS

Supplementary European Search Report for EP 12 78 5968 dated Nov. 3, 2014.

Notification of Reason for Refusal for JP 2013-54219 dated Nov. 6, 2014.

International Search Report and Written Opinion for related PCT application No. PCT/US2012/037461 mailed Nov. 14, 2012.

(56) References Cited

OTHER PUBLICATIONS

International Search Report and Written Opinion for related PCT application No. PCT/US2012/049272 mailed Dec. 14, 2012.
Office Action for U.S. Appl. No. 13/309,927 dated Dec. 5, 2012.
Response to Election of Species for U.S. Appl. No. 13/309,927 dated Dec. 12, 2012.
Office Action for U.S. Appl. No. 13/309,927 dated Jan. 3, 2013.
Amendment A and Response to Office Action for U.S. Appl. No. 13/309,927 dated Apr. 3, 2013.
Office Action for U.S. Appl. No. 13/309,927 dated May 2, 2013.
Amendment B and Response to Final Office Action for U.S. Appl. No. 13/309,927 dated Aug. 30, 2013.
Notice of Allowance and Fee(s) Due for U.S. Appl. No. 13/309,927 dated Sep. 17, 2013.
Part B—Fee(s) Transmittal for U.S. Appl. No. 13/309,927 dated Dec. 12, 2013.
Issue Notification for U.S. Appl. No. 13/309,927 dated Dec. 31, 2013.
Office Action for U.S. Appl. No. 14/103,097 dated Dec. 18, 2014.
Response to Election of Species for U.S. Appl. No. 14/103,097 dated Feb. 10, 2015.
Notice of Allowance and Fee(s) Due for U.S. Appl. No. 14/103,097 dated Mar. 30, 2015.
Part B—Fee(s) Transmittal for U.S. Appl. No. 14/103,097 dated Jun. 5, 2015.
Issue Notification for U.S. Appl. No. 14/103,097 dated Jun. 24, 2015.

* cited by examiner

PACKAGE FOR CONTAINERS

CROSS-REFERENCE TO RELATED APPLICATIONS

This application is a divisional application of U.S. patent application Ser. No. 14/103,097, filed Dec. 11, 2013, which is a divisional application of U.S. patent application Ser. No. 13/309,927, filed Dec. 2, 2011, which claims the benefit of U.S. Provisional Patent Application No. 61/458,931, filed Dec. 3, 2010.

Incorporation by Reference

The disclosures of U.S. patent application Ser. No. 14/103,097, which was filed on Dec. 11, 2013, U.S. patent application Ser. No. 13/309,927, which was filed on Dec. 2, 2011, and U.S. Provisional Patent Application No. 61/458,931, which was filed on Dec. 3, 2010, are hereby incorporated by reference for all purposes as if presented herein in their entirety.

BACKGROUND OF THE DISCLOSURE

The present disclosure generally relates to cartons for holding and dispensing beverage containers, cans, or other types of articles. More specifically, the present disclosure relates to cartons that clip onto a flange of one or more containers.

SUMMARY OF THE DISCLOSURE

In general, one aspect of the disclosure is generally directed to a package comprising a carrier holding at least one container. The at least one container can comprise a rim portion and a body portion. The carrier comprises a top panel, a first side panel foldably connected to the top panel, a second side panel foldably connected to the top panel, a first bottom panel connected to the first side panel by at least one first strut, and a second bottom panel connected to the second side panel by at least one second strut. The carrier further can comprise at least one container-receiving portion comprising a first retaining feature and an opposing second retaining feature. At least a portion of at least one of the first retaining feature and the second retaining feature is disposed in the first side panel or the second side panel. The rim portion of the at least one container can be at least partially retained by at least one of the first retaining feature and the second retaining feature. At least a portion of at least one of the first bottom panel and the second bottom panel is at least partially disposed between a top portion of the at least one container and the top panel.

In another aspect, the disclosure is generally directed to a blank for forming a carrier for at least partially holding at least one container. The at least one container can comprise a rim portion and a body portion. The blank comprises a top panel, a first side panel foldably connected to the top panel, a second side panel foldably connected to the top panel, a first bottom panel connected to the first side panel by at least one first strut, and a second bottom panel connected to the second side panel by at least one second strut. The blank further can comprise receiving features for forming at least one container-receiving portion comprising a first retaining feature and an opposing second retaining feature in the carrier formed from the blank. At least a portion of at least one of the first retaining feature and the second retaining feature is disposed in the first side panel or the second side panel in the carrier formed from the blank. At least one of the first retaining feature and the second retaining feature is for at least partially retaining the rim portion of the at least one container in the carrier fondled from the blank. At least a portion of at least one of the first bottom panel and the second bottom panel is for being at least partially disposed between a top portion of the at least one container and the top panel.

In another aspect, the disclosure is generally directed to a method of assembling a carrier. The method can comprise obtaining a blank comprising a top panel, a first side panel foldably connected to the top panel, a second side panel foldably connected to the top panel, a first bottom panel connected to the first side panel by at least one first strut, and a second bottom panel connected to the second side panel by at least one second strut. The method further can comprise positioning the first bottom panel and the second bottom panel to be at least partially overlapped by the top panel, and positioning the at least one container so that at least a portion of at least one of the first bottom panel and the second bottom panel is at least partially disposed between a top portion of the at least one container and the top panel. The method can also comprise forming at least one container-receiving portion by folding at least one of the first side panel and the second side panel inwardly and forming a first retaining feature and an opposing second retaining feature so that the rim portion of the at least one container is at least partially retained by at least one of the first retaining feature and the second retaining feature. At least a portion of at least one of the first retaining feature and the second retaining feature is disposed in the first side panel or the second side panel.

Other aspects, features, and details of the present disclosure can be more completely understood by reference to the following detailed description, taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded ore reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, constructs, sleeves, cartons, or the like, and packages for holding and displaying containers such as cups, jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

In the illustrated embodiment, each of the containers can include a rim portion, which can be at or near the top end of the respective container. The rim portion can include a rim, such as a flange extending from a single-serving cup (e.g., the containers C1 in FIGS. 4-6) or a chime on a can (e.g., the containers C2 in FIGS. 10-12). The rim portions of the containers can be otherwise configured or omitted without departing from the disclosure.

Carriers according to the present disclosure can accommodate containers of numerous different shapes. For the purpose of illustration and not for the purpose of limiting the scope of the disclosure, the following detailed description describes food product containers (e.g., plastic containers or aluminum cans) at least partially disposed within the carrier embodiments. In this specification, the terms "lower," "bottom," "upper" and "top" indicate orientations determined in relation to fully erected carriers or packages.

The present embodiments are addressed to carriers or packages for attachment to and accommodation of containers. A carton or carrier 150 is illustrated in its erected state in FIGS. 3-6, in which it is attached to containers C1, forming a package 160. In the illustrated embodiments the containers C1 are illustrated as single-serving plastic cups having a top portion generally comprising a flange portion F and a bottom portion or body B; however, other containers may be held in the package 160 without departing from the disclosure.

Figure 1:
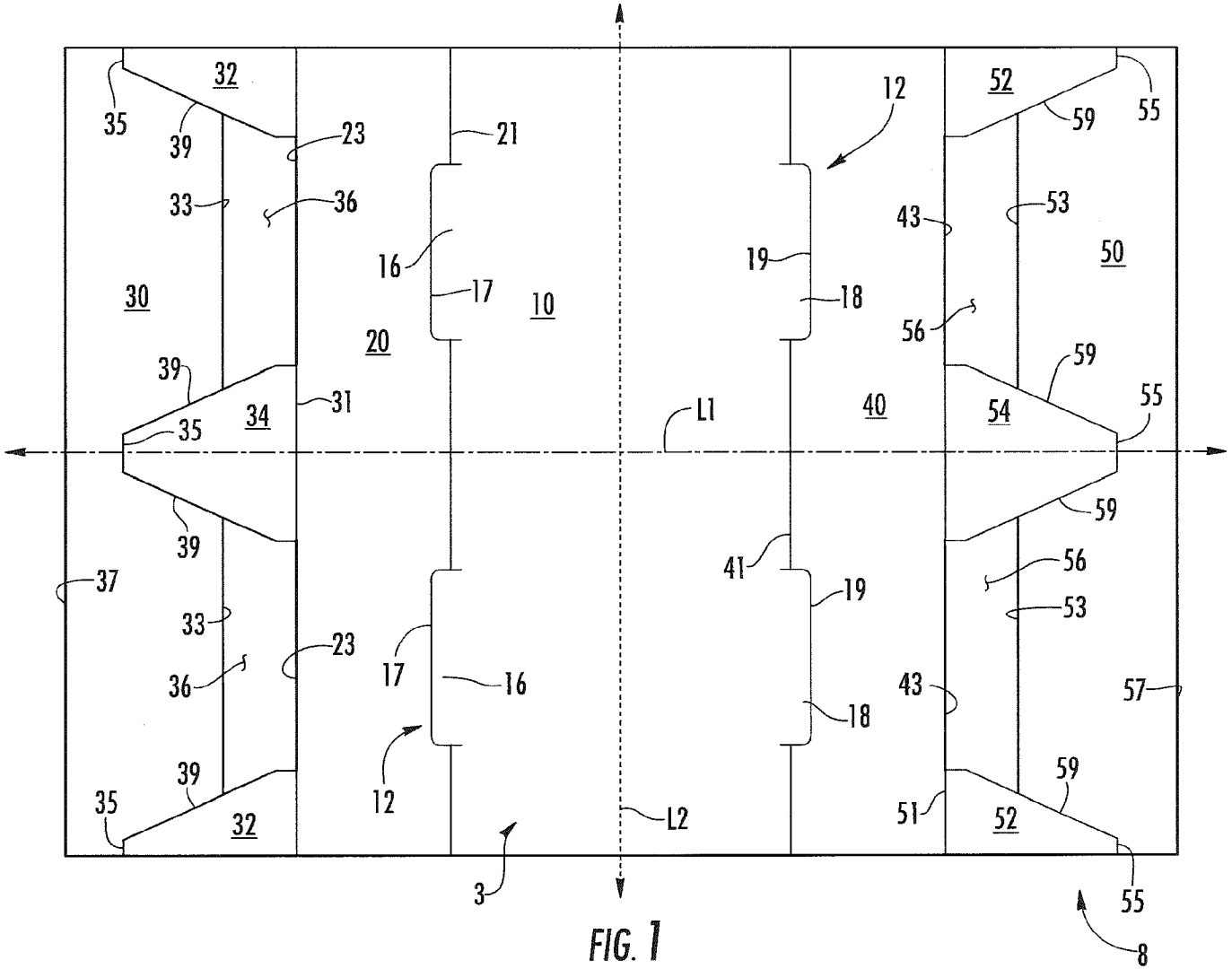
FIG. 1 is a plan view of a blank used to form a package according to a first embodiment of the disclosure.

FIG. 1 is a plan view of an exterior side 3 of a blank 8 used to form a carton or carrier 150 according to an embodiment of the disclosure. The blank 8 has a longitudinal axis L1 and a lateral axis L2. As shown in FIG. 1, the blank 8 may be wholly or partially symmetric about the longitudinal axis L1 and the lateral axis L2. Therefore, certain elements in the drawing figures share common reference numerals in order to reflect the whole and/or partial symmetries.

Referring to FIG. 1, the blank 8 comprises a top panel 10 foldably connected to a first side panel 20 at a first transverse fold line 21, a first bottom panel 30 foldably connected to the first side panel 20 at a second transverse fold line 31, a second side panel 40 foldably connected to the top panel 10 at a third transverse fold line 41, and a second bottom panel 50 foldably connected to the second side panel 40 at a fourth transverse fold line 51.

One or more cuts may be included in each of the transverse fold lines 21, 31, 41, 51 to facilitate folding along the fold lines. Any number of cuts may be formed in any of the fold lines, and the number and length of the cuts may be selected according to, for example, the gauge and/or the stiffness of the material used to form the blank 8. The fold lines 21, 31, 41, 51 may be formed by other methods (e.g., crease lines without cuts) without departing from the disclosure.

Figure 4:
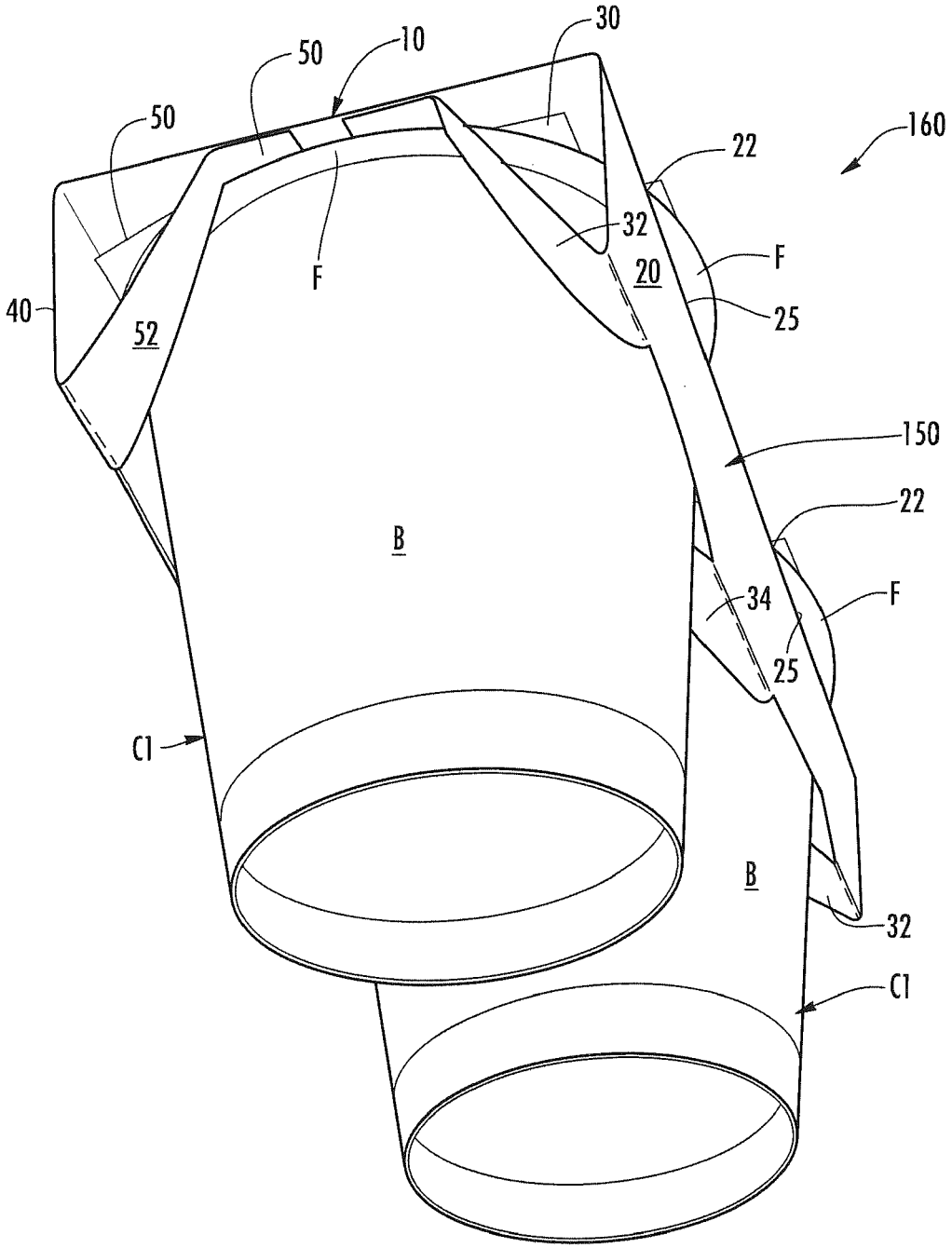
FIG. 4 is a perspective view of the package of FIG. 3 from the bottom.
Figure 5:
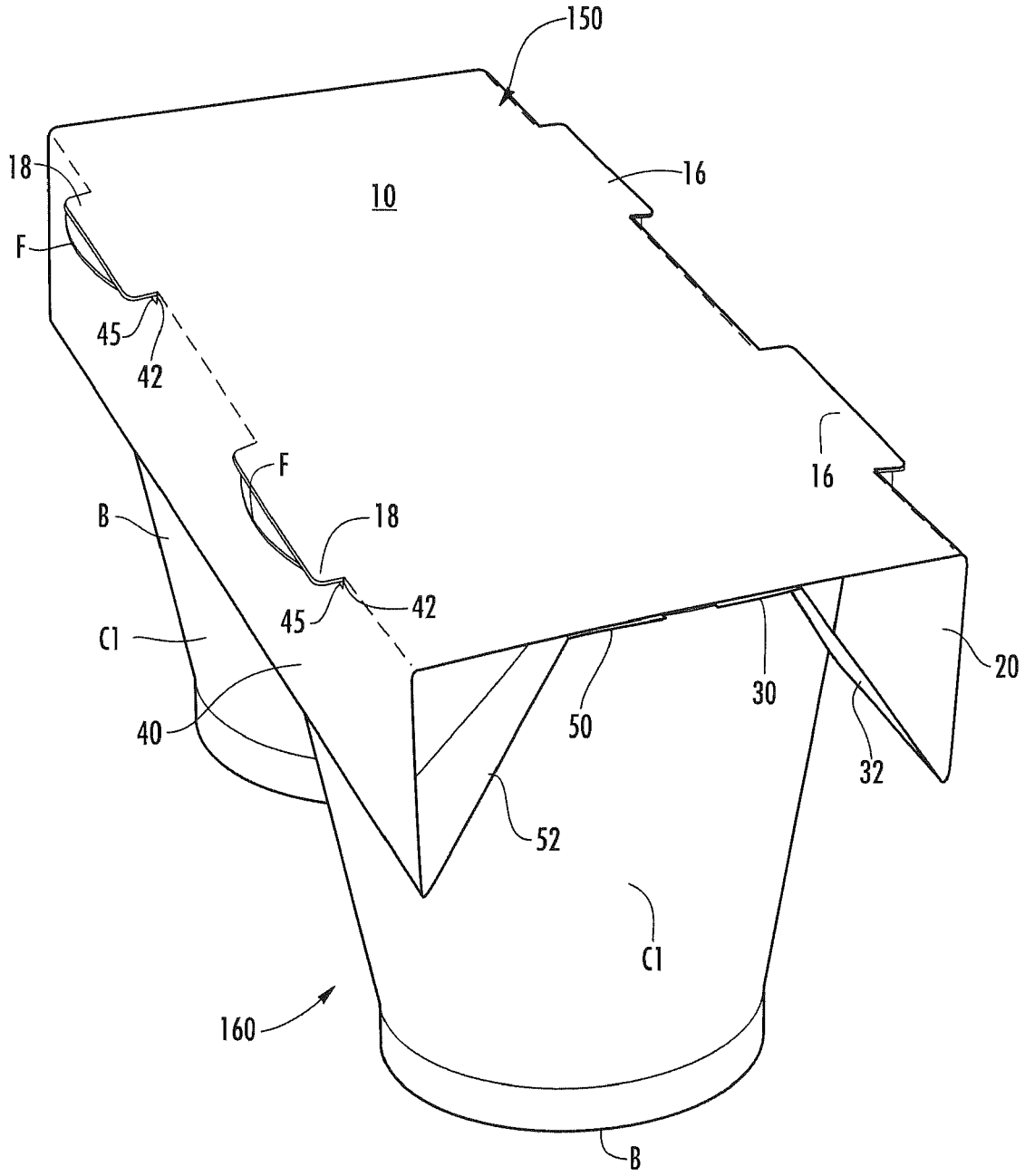
FIG. 5 is a perspective view of the package of FIG. 3 from the top.
Figure 6:
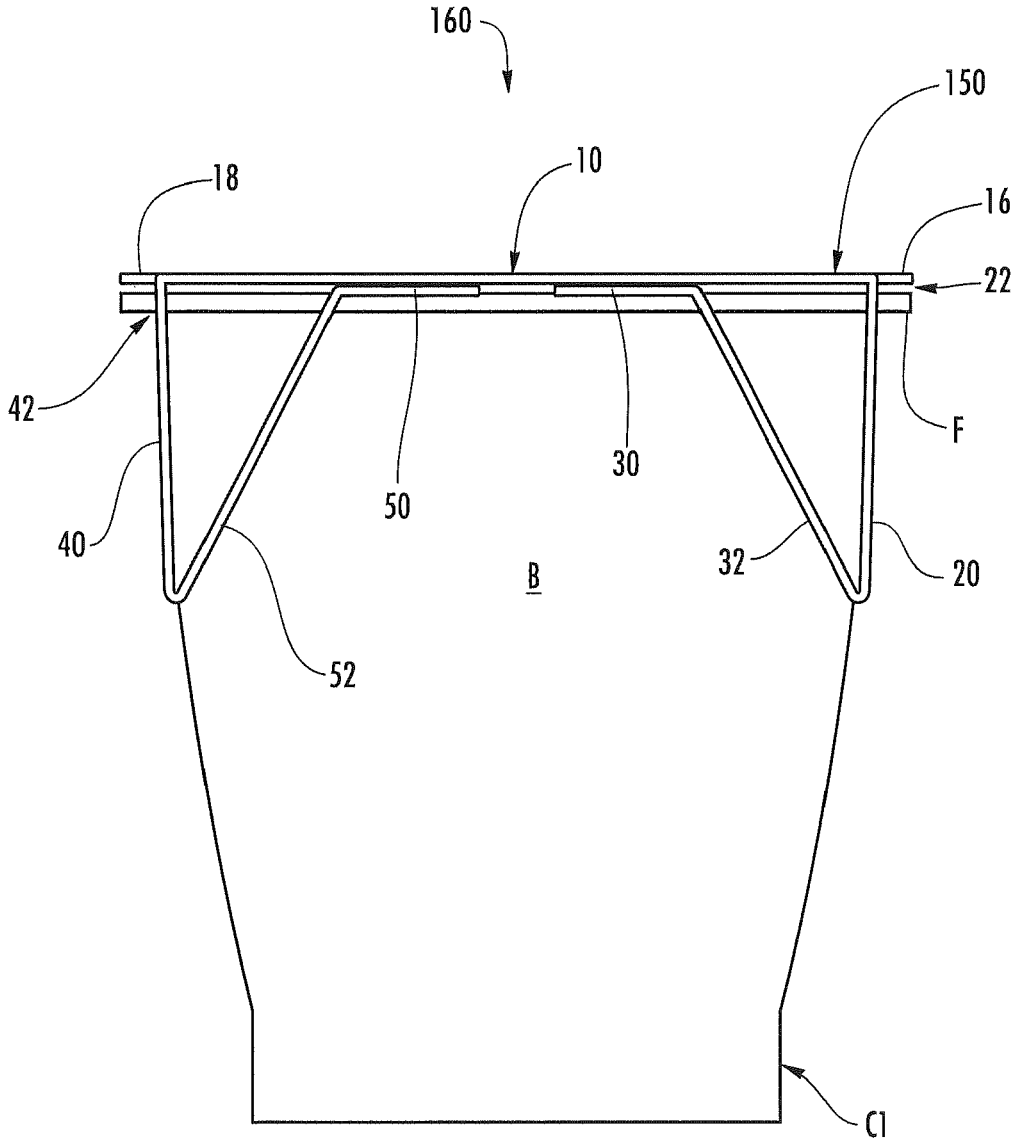
FIG. 6 is an end view of the package of FIG. 3.

In the illustrated embodiment, the blank 8 includes two receiving features forming respective container-receiving portions 12 arranged in a single row. Each container-receiving portion 12 is shaped and sized to receive an upper portion of a container C1 that is to be held within the erected carrier 150. In the exemplary embodiment, two containers C1 are accommodated in the erected carrier 150, forming the 1×2 package 160. Other package configurations, such as 1×3, 1×4, or 2×2, etc., are also within the scope of the present disclosure. The receiving features of each container-receiving portion 12 include a first tab 16 extending across the first transverse fold line 21 and a second tab 18 extending across the third transverse fold line 41, opposite to the first tab 16. The first tabs 16 are each defined by a tear line or cut line 17, extending in the top panel 10 and into the side panel 20. Similarly, the second tabs 18 are each defined by a tear line or cut line 19 extending in the top panel 10 and into the side panel 40. In the erected carrier, the tabs 16, 18 separate from the respective side panels 20, 40 at the respective cut lines 17, 19 to respectively form retaining features in the form of opposing side openings 22, 42 with respective bottom or retaining edges 25, 45 in the respective side panels 20, 40 (FIGS. 4-6). The side openings 22, 42 of each container-receiving portion 12 are for engaging the flange F on opposite sides of a container C1.

In the illustrated embodiment, the first bottom panel 30 is connected to the first side panel 20 by two first outer struts 32 and a first inner strut 34. An opening 36 is defined between each first outer strut 32 and the first inner strut 34. The openings 36 can be further defined between an inner edge 33 of the first bottom panel 30 and an inner edge 23 of the first side panel 20. Each opening 36 is generally aligned with a respective container-receiving portion 12 so that at least a portion of a first outer strut 32 and the first inner strut 34 are disposed on either side of the respective container-receiving portion. The first struts 32, 34 are each foldably connected to the first side panel 20 at the transverse fold line 31 and to the first bottom panel 30 at the transverse fold lines 35. As shown in FIG. 1, the transverse fold lines 35 extend in the first bottom panel 30, spaced apart from the lateral inner edge 33 and a lateral outer edge 37 of the first bottom panel. The first struts 32, 34 are separable from the first bottom panel 30 along oblique cut lines 39. In an alternative embodiment, the cut lines 39 can be tear lines or another form of weakening. The first struts can have a generally trapezoidal shape, wherein the fold lines 35 are shorter than the portion of the respective struts connected to the side panel 20 at fold line 31.

In the illustrated embodiment, the second bottom panel 50 is connected to the second side panel 40 by two second outer struts 52 and a second inner strut 54. An opening 56 is defined between each second outer strut 52 and the second inner strut 54. The openings 56 can be further defined between an inner edge 53 of the second bottom panel 50 and an inner edge 43 of the second side panel 40. Each opening 56 is generally aligned with a respective container-receiving portion 12 so that at least a portion of a second outer strut 52 and the second inner strut 54 are disposed on either side of the respective container-receiving portion. Each of the second outer struts 52 are further generally aligned with the respective first outer struts 32, and the second inner strut 54 is generally aligned with the first inner strut 34. The second struts 52, 54 are each foldably connected to the second side panel 40 at the transverse fold line 51 and to the second bottom panel 50 at the transverse fold lines 55. As shown in FIG. 1, the transverse fold lines 55 extend in the second bottom panel 50, spaced apart from the lateral inner edge 53 and a lateral outer edge 57 of the first bottom panel. The second struts 52, 54 are separable from the second bottom panel 50 along oblique cut lines 59. In an alternative embodiment, the cut lines 59 can be tear lines or another form of weakening. The second struts can have a generally trapezoidal shape, wherein the fold lines 55 are shorter than the portion of the respective struts connected to the side panel 40 at fold line 51.

In an alternative embodiment, more than one inner strut 34, 54 can be included in each set of inner and outer struts. For example, an alternative carrier having four container-receiving portions in a single row can include three inner struts disposed between each set of outer struts. In a further alternative, a carrier can include one container-receiving portion and no inner struts.

Figure 2:
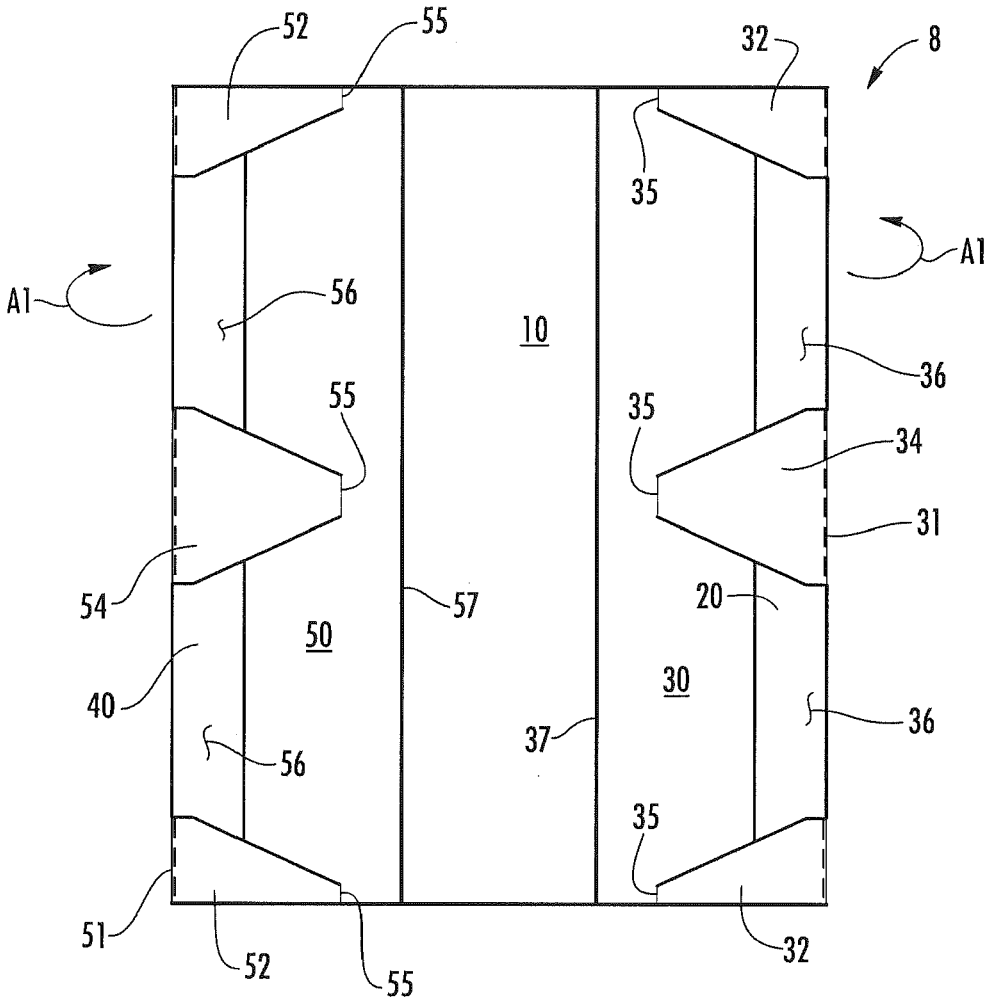
FIG. 2 is a plan view of a partially-formed package according to the first embodiment of the disclosure.
Figure 3:
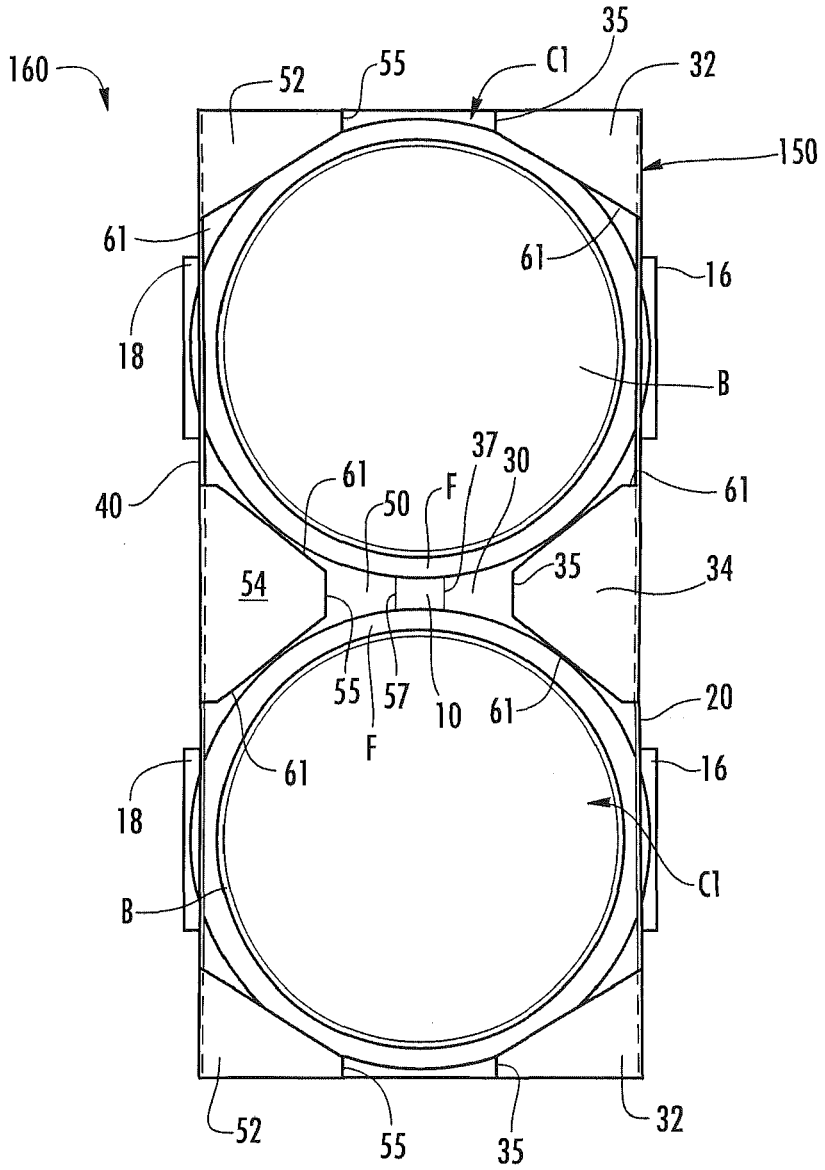
FIG. 3 is a bottom view of the erected package according to the first embodiment of the disclosure.

An exemplary method of erection of the carrier 150 to form the package 160 is discussed below with reference to FIGS. 2-4. As shown in FIG. 2, which is a view from the bottom of the blank 8, the bottom panels 30, 50 and struts 32, 34, 52, 54 are folded along the respective fold lines 31, 51 in the direction of arrows Al so that the bottom panels 30, 50 are in face-to-face contact with the at least a portion of the interior surfaces of the top panel 10 and the respective side panels 20, 40. A container C1 can be placed on the bottom panels 30, 50 over each of the container-receiving portions 12, between the outer struts 32, 52 and the respective inner struts 34, 54. The side panels 20, 40 can be folded inwardly along respective fold lines 21, 41, causing the bottom panels 30, 50 to slide inwardly between the flanges F of the containers C1 and the top panel 10 until the side panels 20, 40 are generally perpendicular to the top panel 10 (FIG. 6). As the side panels 20, 40 fold inwardly, the struts 32, 34, 52, 54 separate from the respective bottom panels 30, 50 at the cut lines 39, 59 to form oblique edges 61 as the struts 32, 34 and 52, 54 fold along respective fold lines 31, 35 and 51, 55 to extend upwardly and obliquely from the respective bottom panels 30, 50 to the respectively adjacent side panels 20, 40. The inner struts 34, 54 extend partially between the containers C1 with the edges 61 extending proximate or adjacent the inner sides of the bodies B of the containers. The outer struts 32, 52 extend proximate or adjacent the outer sides of the bodies B of the containers.

Further, as the side panels 20, 40 fold inwardly, retaining features (e.g., the side openings 22, 42) are formed in the respective side panels 20, 40 adjacent the respective tabs 16, 18 extending from the top panel 10. As shown in FIGS. 3-6, the flange F of each container C1 extends through the side openings 22, 42 of the respective container-receiving portion 12, which helps retain the container C1 within the carrier 150 to faun the package 160. According to one embodiment, the side openings 22, 42 are disposed so that the respective retaining edges 25, 45 of the side openings force the flange F of each container upwardly to push the bottom panels 30, 50 against the top panel 10. Accordingly, the struts 32, 34, 52, 54 are pulled upwardly with the bottom panels 30, 50 to thereby pull the side panels 20, 40 inwardly against the bodies B of the containers C1 (FIGS. 3 and 4).

Accordingly, in the illustrated embodiment, the containers C1 can be retained in the carrier 150 without requiring adhesives or other fasteners. Instead, the containers C1 are supported at the flanges F by the retaining edges 25, 45 of the respective side openings 20, 40 and retained at the bodies B by the side panels 20, 40, which can squeeze the bodies B therebetween. Any force tending to pull one or more of the containers C1 away from the carrier 150 can be resisted by the retaining edges 25, 45 engaging the flanges F. Any force tending to pull one or both of the side panels 20, 40 away from the containers C1 can be resisted by the respective bottom panels 30, 50 via the respective struts 32, 34 and 52, 54, the bottom panels being retained between the flanges F and the top panel 10. In an alternative embodiment, the carrier 150 can be otherwise arranged or erected without departing from the present disclosure. For example, one or both of the bottom panels can be glued to the top panel.

The erected package 160 is shown in FIGS. 3-6. In the illustrated embodiment, the carrier 150 is open-ended, and the side panels 20, 40 extend generally downwardly from the top panel 10. The side panels 20, 40 can also at least partially conform to the shape of the containers C1 (e.g., the side panels 20, 40 can include curved portions adjacent the containers C1). A user can easily grasp the carrier 150 at the bottom edges of the side panels 20, 40 or at the open ends in order to carrier the package 160. In an alternative embodiment, one or more end panels can be foldably connected to one or more of the top panel 10, the side panels 20, 40, the bottom panels 30, 50, and the outer struts 32, 52.

Figure 7:
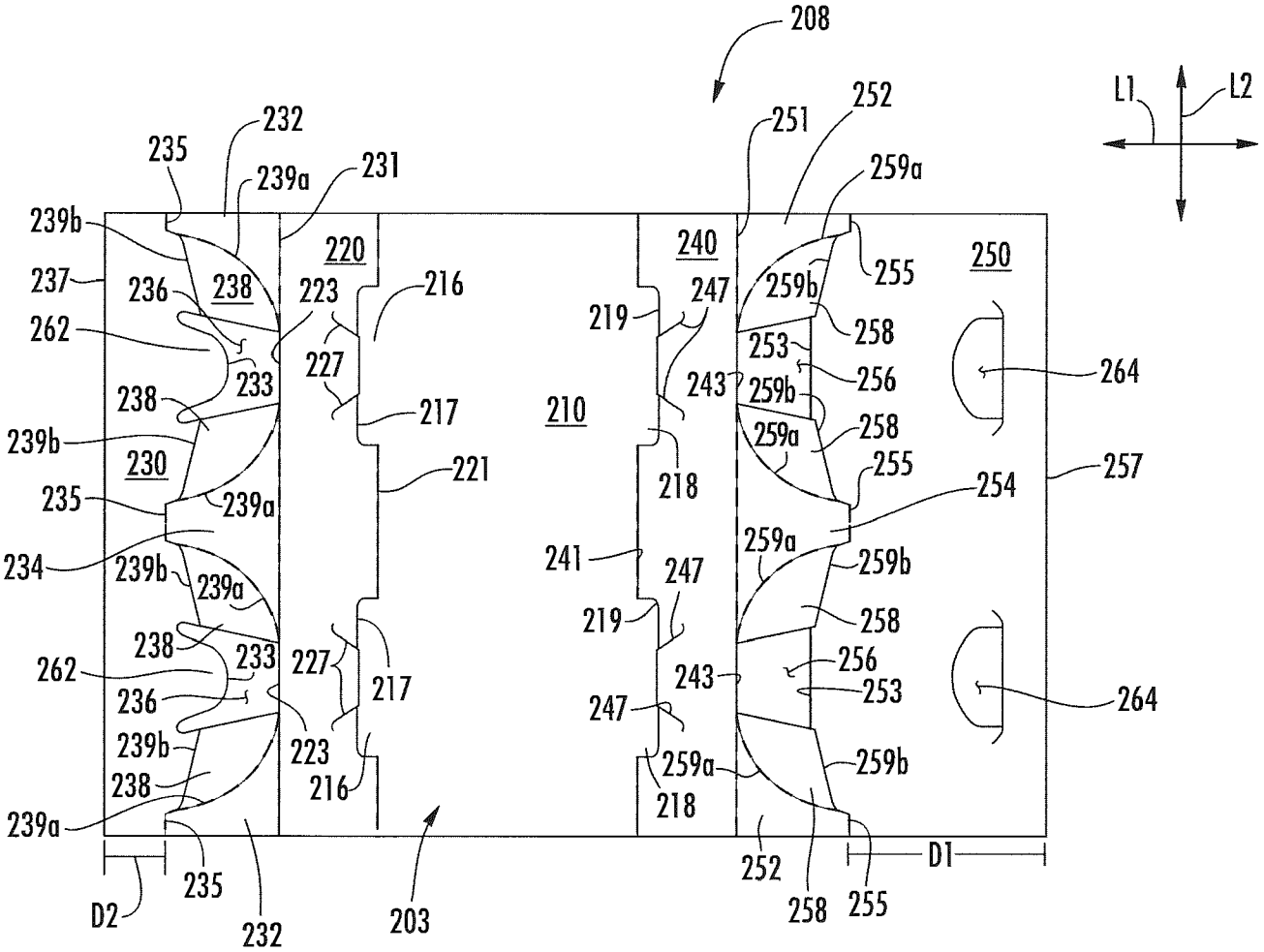
FIG. 7 is a plan view of a blank used to form a package according to a second embodiment of the disclosure.

FIG. 7 illustrates an exterior side 203 of a blank 208 for forming a carton or carrier 350 according to a second embodiment of the disclosure. The second embodiment is generally similar to the first embodiment, except for variations noted and variations that will be apparent to one of ordinary skill in the art. The blank 208 has a longitudinal axis L1 and a lateral axis L2. The carrier 350 is illustrated in its erected state in FIGS. 9-12, in which it is attached to upper portions of containers C2, forming a package 360. In the illustrated embodiments the containers C2 are illustrated as aluminum cans having a top portion generally comprising a rim in the form of a ridge or chime R (FIGS. 11 and 12) and a bottom portion or body B; however, other containers may be held in the package 360 without departing from the disclosure.

Referring to FIG. 7, the blank 208 comprises a top panel 210 foldably connected to a first side panel 220 at a first transverse fold line 221, a first bottom panel 230 foldably connected to the first side panel 220 at a second transverse fold line 231, a second side panel 240 foldably connected to the top panel 210 at a third transverse fold line 241, and a second bottom panel 250 foldably connected to the second side panel 240 at a fourth transverse fold line 251.

One or more cuts may be included in each of the transverse fold lines 221, 231, 241, 251 to facilitate folding along the fold lines. Any number of cuts may be formed in any of the fold lines, and the number and length of the cuts may be selected according to, for example, the gauge and/or the stiffness of the material used to form the blank 208. The fold lines 221, 231, 241, 251 may be formed by other methods (e.g., crease lines without cuts) without departing from the disclosure.

Figure 9:
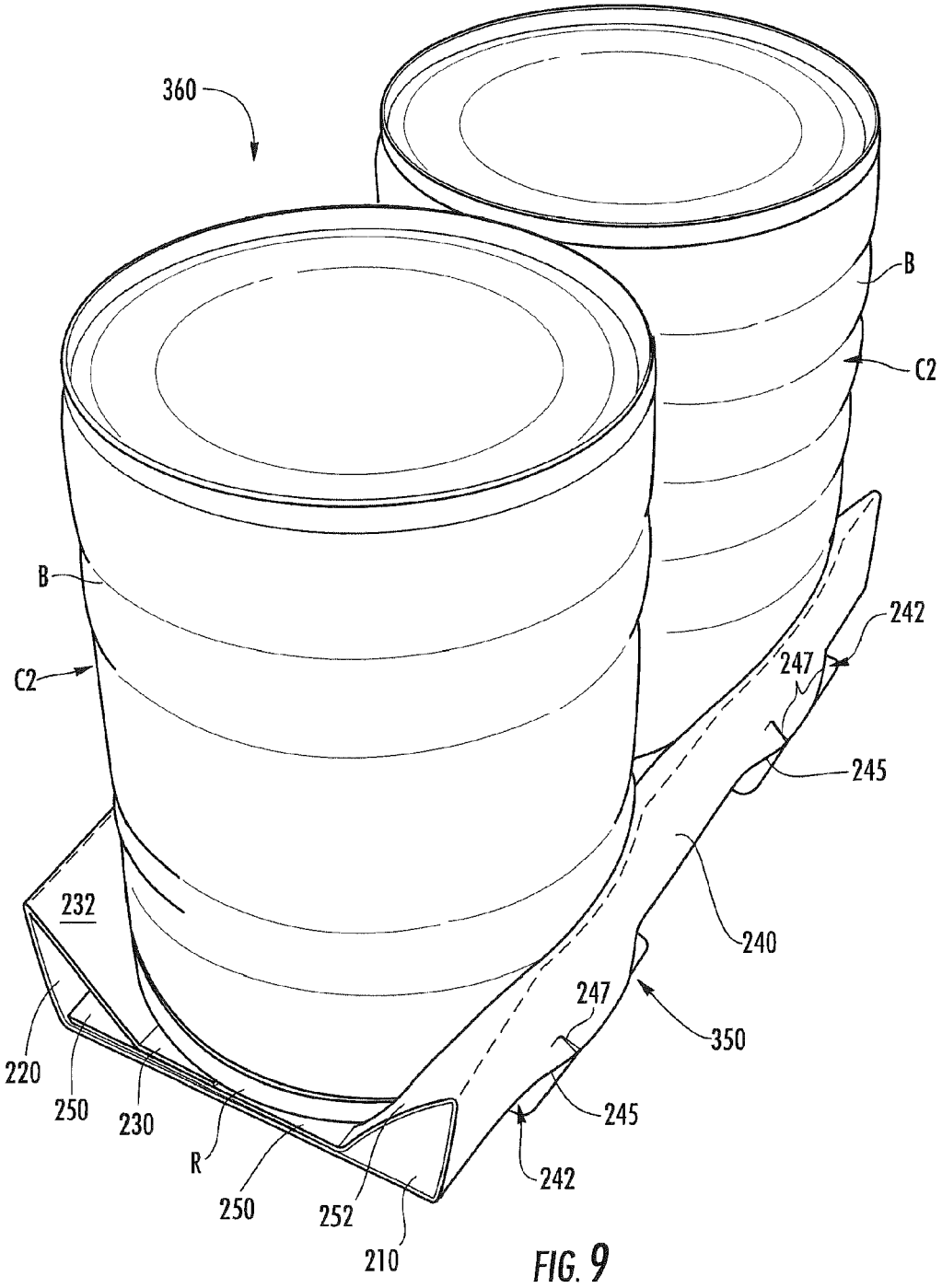
FIG. 9 is a bottom perspective view of the erected package according to the second embodiment of the disclosure.
Figure 10:
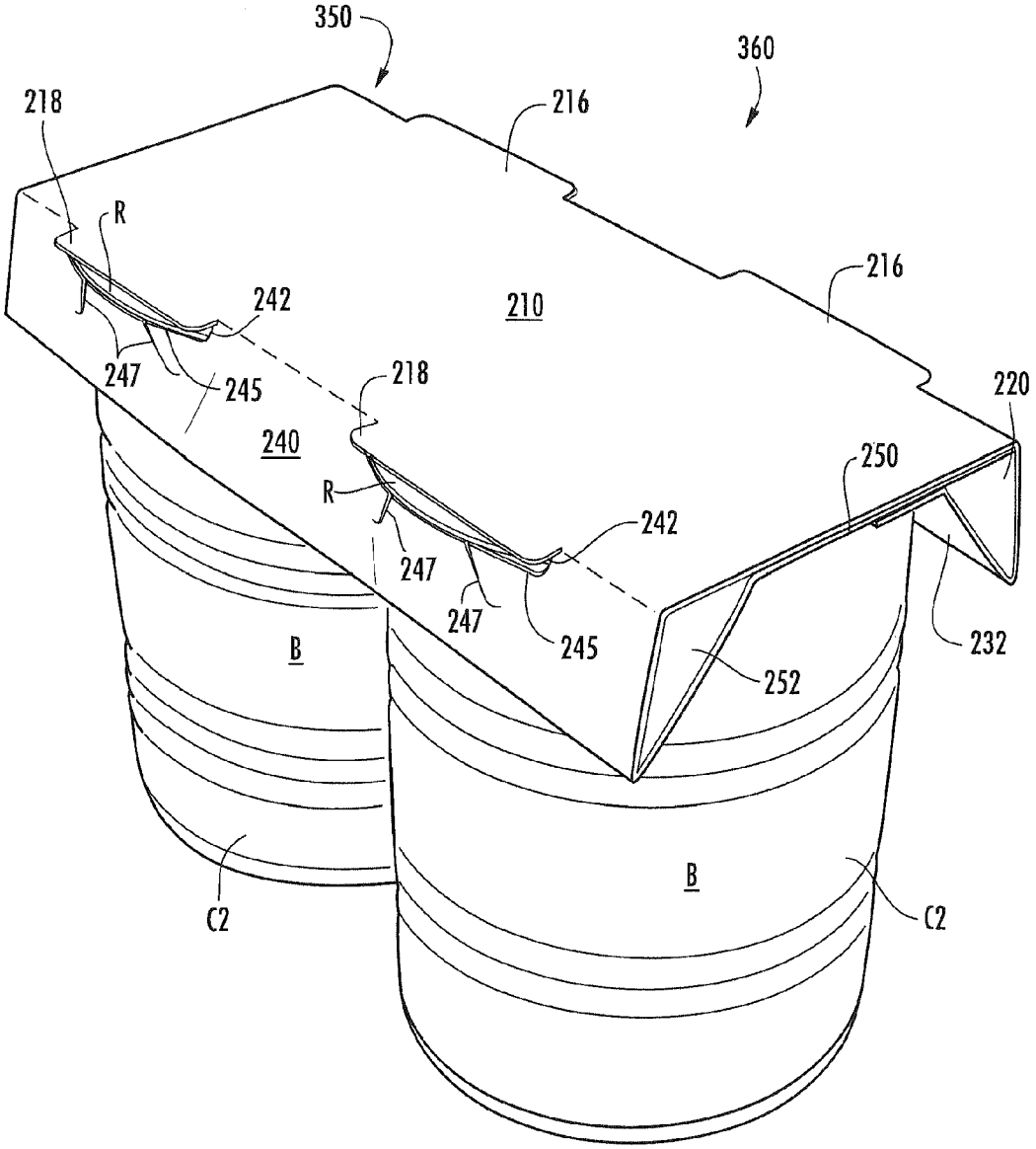
FIG. 10 is a top perspective view of the erected package according to the second embodiment of the disclosure.
Figure 12:
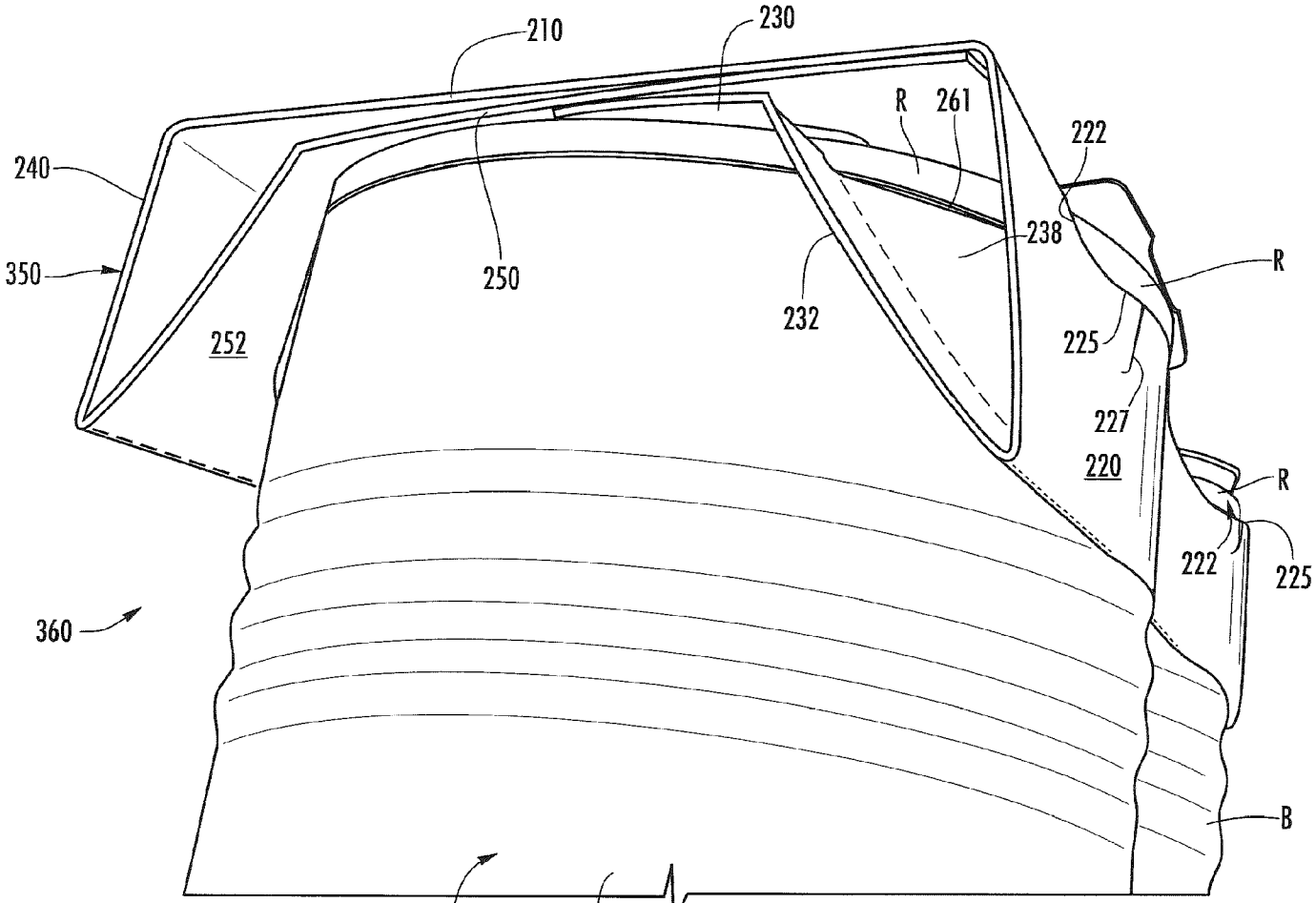
FIG. 12 is a perspective view of an end of the package of FIG. 10.

In the illustrated embodiment, the blank 208 includes receiving features for forming two container-receiving portions 212 arranged in a single row. Each container-receiving portion 212 is shaped and sized to receive an upper portion of a container C2 that is to be held within the erected carrier 350. In the exemplary embodiment, two containers C2 are accommodated in the erected carrier 350, farming the 1×2 package 360. Other package configurations, such as 1×3, 1×4, or 2×2, etc. are also within the scope of the present disclosure. The receiving features of each container-receiving portion 212 include a first tab 216 extending across the first transverse fold line 221 and a second tab 218 extending across the third transverse fold line 241, opposite to the first tab 216. The first tabs 216 are each defined by a tear line or cut line 217, extending in the top panel 210 and into the side panel 220. Similarly, the second tabs 218 are each defined by a tear line or cut line 219 extending in the top panel 210 and into the side panel 240. In the erected carrier 350, the tabs 216, 218 separate from the respective side panels 220, 240 at the respective cut lines 217, 219 to respectively form retaining features in the form of opposing side openings 222, 242 with respective bottom or retaining edges 225, 245 in the respective side panels 220, 240 (FIGS. 9, 10, and 12). The side openings 222, 242 of each container-receiving portion 212 are for engaging the chime R on opposite sides of a container C2.

As shown in FIG. 7, two oblique cuts 227 can extend from each of the cut lines 217 in the first side panel 220, and two oblique cuts 247 extend from each of the cut lines 219 in the second side panel 240. The cuts 227, 247 allow the respective side panels 220, 240 to better conform to the shape of the containers C2 proximate the respective openings 222, 242 to maximize the amount of the retaining edges 225, 245 of the respective openings that engages the chimes R of the containers. The cuts 227, 247 can be alternatively configured or omitted without departing from the scope of this disclosure.

In the illustrated embodiment, the first bottom panel 230 is connected to the first side panel 220 by two first outer struts 232 and a first inner strut 234. An opening 236 is defined between each first outer strut 232 and the first inner strut 234. The openings 236 can be further defined between an inner edge 233 of the first bottom panel 230 and an inner edge 223 of the first side panel 220. Each opening 236 is generally aligned with a respective container-receiving portion 212 so that at least a portion of a first outer strut 232 and the first inner strut 234 are disposed on either side of the respective container-receiving portion. The first struts 232, 234 are each foldably connected to the first side panel 220 at the transverse fold line 231 and to the first bottom panel 230 at the transverse fold lines 235. As shown in FIG. 7, the transverse fold lines 235 extend in the first bottom panel 230, spaced apart from the lateral inner edge 233 and a lateral outer edge 237 of the first bottom panel.

As shown in FIG. 7, the first outer struts 232 each includes an extension 238 (e.g., extension flap) connected to the respective outer strut at a curved fold line 239*a* and separable from the first bottom panel 230 along a cut line 239*b*. Similarly, the first inner strut 234 can include two extensions 238 (e.g., extension flaps) connected to either side of the inner strut at a curved fold line 239*a* and separable from the first bottom panel 230 along cut lines 239*b*. In an alternative embodiment, the cut lines 239*b* can be tear lines or another form of weakening. Further, the struts 232, 234 and the extensions 238 can be alternatively configured or omitted without departing from the scope of the present disclosure.

The second bottom panel 250 is connected to the second side panel 240 by two second outer struts 252 and a second inner strut 254. An opening 256 is defined between each second outer strut 252 and the second inner strut 254. The openings 256 can be further defined between an inner edge 253 of the second bottom panel 250 and an inner edge 243 of the second side panel 240. Each opening 256 is generally aligned with a respective container-receiving portion 212 so that at least a portion of a second outer strut 252 and the second inner strut 254 are disposed on either side of the respective container-receiving portion. Each of the second outer struts 252 are further generally aligned with the respective first outer struts 232, and the second inner strut 254 is generally aligned with the first inner strut 234. The second struts 252, 254 are each foldably connected to the second side panel 240 at the transverse fold line 251 and to the second bottom panel 250 at the transverse fold lines 255. As shown in FIG. 7, the transverse fold lines 255 extend in the second bottom panel 250, spaced apart from the lateral inner edge 253 and a lateral outer edge 257 of the first bottom panel.

As shown in FIG. 7, the second outer struts 252 each includes an extension 258 (e.g., extension flap) connected to the respective outer strut at a curved fold line 259*a* and separable from the first bottom panel 250 along a cut line 259*b*. Similarly, the second inner strut 254 can include two extensions 258 (e.g., extension flaps) connected to either side of the inner strut at a curved fold line 259*a* and separable from the first bottom panel 250 along cut lines 259*b*. In an alternative embodiment, the cut lines 259*b* can be tear lines or another form of weakening. Further, the struts 252, 254 and the extensions 258 can be alternatively configured or omitted without departing from the scope of the present disclosure.

According to the second embodiment as illustrated in FIG. 7, the second bottom panel 250 extends a longer distance D1 in the longitudinal direction L1 from the fold lines 255 to the edge 257 than the distance D2 of the first bottom panel 230 extending in the longitudinal direction L1 between the fold lines 235 and the edge 237. Accordingly, locking features including the first bottom panel can include a locking flap 262 adjacent each of the openings 236, and the second bottom panel can include two corresponding locking apertures 264 that are generally aligned with the respective locking flaps 262. Accordingly, the first bottom panel 230 can overlap the second bottom panel 250 and the locking flaps 262 can engage the respective locking apertures 264 (FIG. 8) to lock the bottom panels together.

Figure 8:
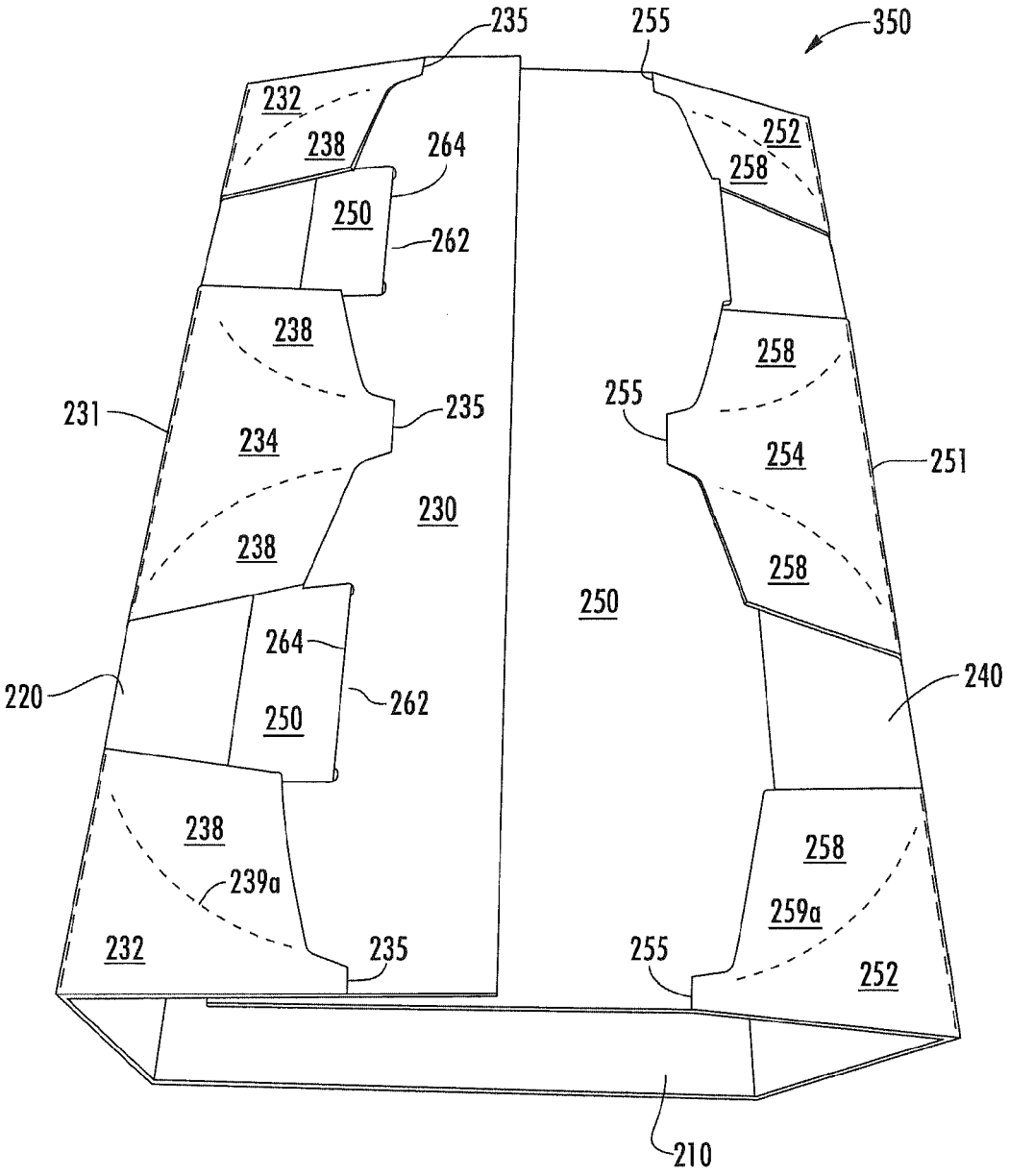
FIG. 8 is a perspective view of a partially-formed package according to the second embodiment of the disclosure.
Figure 11:
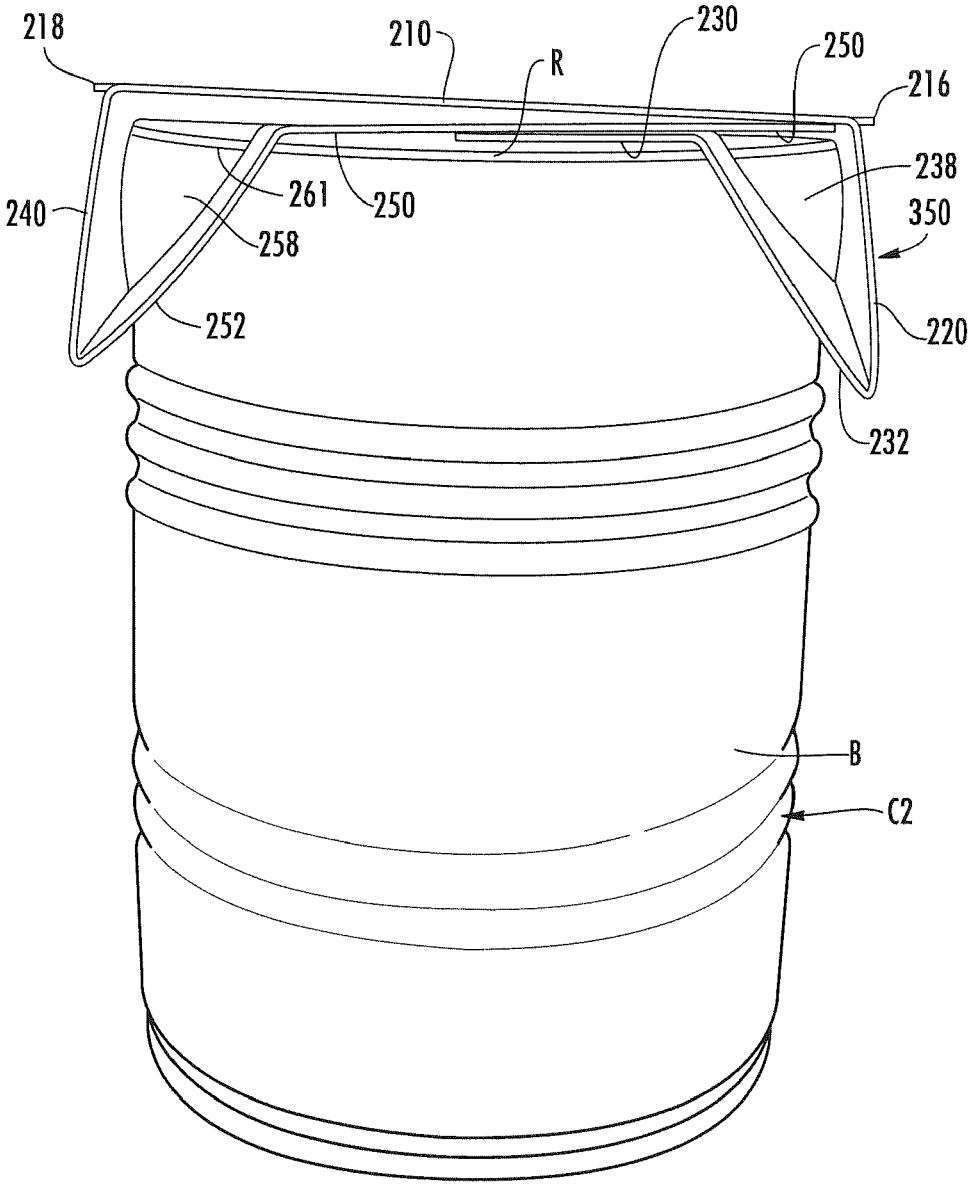
FIG. 11 is an end view of the package of FIG. 10.

An exemplary method of erection of the carrier 350 to form the package 360 is discussed below with reference to FIGS. 8-12. As shown in FIG. 8, which is a view from the bottom of the blank 208, the bottom panels 230, 250 and struts 232, 234, 252, 254 are folded along the respective fold lines 231, 251 so that the first bottom panel 230 is at least partially overlapped by the second bottom panel 250. The locking tabs 262 of the first bottom panel 230 are inserted into the locking apertures 264 of the second bottom panel 250. In one embodiment, the first bottom panel 230 can extend downwardly from the second bottom panel 250 when the locking flaps 262 are first inserted into the locking apertures 264 and then can be pivoted into face-to-face contact with the second bottom panel 250 as the locking flaps 262 are inserted. A container C2 can be placed on the bottom panels 230, 250 over each of the container-receiving portions 212, between the outer struts 232, 252 and inner struts 234, 254. The chime R of each container C2 can overlay the extensions 238, 258 within the curved fold lines 239*a*. The side panels 220, 240 can be folded inwardly along the respective fold lines 221, 241, while pushing the containers C2 toward the top panel 210 to force the bottom panels 230, 250 against the top panel 210. As the side panels 220, 240 fold inwardly, the struts 232, 234, 252, 254 separate from the respective bottom panels 230, 250 at the cut lines 239*b* to form oblique edges 261 as the struts fold along respective fold lines 231, 235 and 251, 255 to extend between the bottom panels and the adjacent side panels. The inner struts 234, 254 extend partially between the containers C2 proximate or adjacent the inner sides of the bodies B of the containers. The outer struts 232, 252 extend proximate or adjacent the outer sides of the bodies B of the containers. The extensions 238, 258 are pushed toward the respective side panels 220, 240 by the bodies B as the containers are pushed toward the top panel 210 (FIGS. 11 and 12).

Further, as the side panels 220, 240 fold inwardly, the retaining features (e.g., the side openings 222, 242) are formed in the respective side panels 220, 240 adjacent the respective tabs 216, 218 extending from the top panel 210. When the chime R of each container C2 engages the openings 222, 242, the respective retaining edges 225, 245 engage an outer portion of the underside of each chime R (FIGS. 11 and 12), and the edges 261 of the extensions 238, 258 further engage inner portions of the underside of the chimes R (FIGS. 11 and 12). The package 360 with the erected carrier 350 secured to the top portions of the containers C2 is shown in FIGS. 9-12. Similarly to the first embodiment, the side openings 222, 242 are disposed so that the respective retaining edges 225, 245 force the chime R of each container upwardly to push the bottom panels 230, 250 against the top panel 210. Accordingly, the struts 232, 234, 252, 254 are pulled upwardly with the bottom panels 230, 250 to thereby pull the side panels 220, 240 inwardly against the bodies B of the containers C2 (FIGS. 9 and 11).

Accordingly, in the illustrated embodiment, the containers C2 can be retained in the carrier 350 without requiring adhesives or other fasteners. Instead, the containers C2 are supported at the chimes R by the retaining edges 225, 245 of the respective side openings 220, 240 and retained at the bodies B by the side panels 220, 240, which squeeze the bodies B therebetween. Any force tending to pull one or more of the containers C2 away from the carrier 350 is resisted by the retaining edges 225, 245 and the edges 261 of the extensions 238, 258 engaging the chimes R. Any force tending to pull one or both of the side panels 220, 240 away from the containers C2 is resisted by the respective bottom panels 230, 250 via the respective struts 232, 234 and 252, 254, the bottom panels being retained between the chimes R and the top panel 210. The engagement of the locking flaps 262 and the locking apertures 264 helps prevent the bottom panels 230, 250 from moving away from one another toward the respective side panels 220, 240. Accordingly, the locking features further can resist movement of the side panels 220, 240 away from the containers C2.

The erected package 360 is shown in FIGS. 9-12. In the illustrated embodiment, the carrier 350 is open-ended, and the side panels 220, 240 extend generally downwardly from the top panel 210. The side panels 220, 240 can also at least partially conform to the shape of the containers C2, and can include curved portions that at least partially conform to the shape of the bodies B of the containers C2. Accordingly, more of the side panels 220, 240 contact the bodies B than if the side walls did not conform to the bodies, and more of the retaining edges 225, 245 can contact the chimes R to further retain the containers C2. A user can easily grasp the carrier 350 at the bottom edges of the side panels 220, 240 or at the open ends in order to carrier the package 360. In an alternative embodiment, one or more end panels can be foldably connected to one or more of the top panel 210, the side panels 220, 240, the bottom panels 230, 250, and the outer struts 232, 252.

Figure 13:
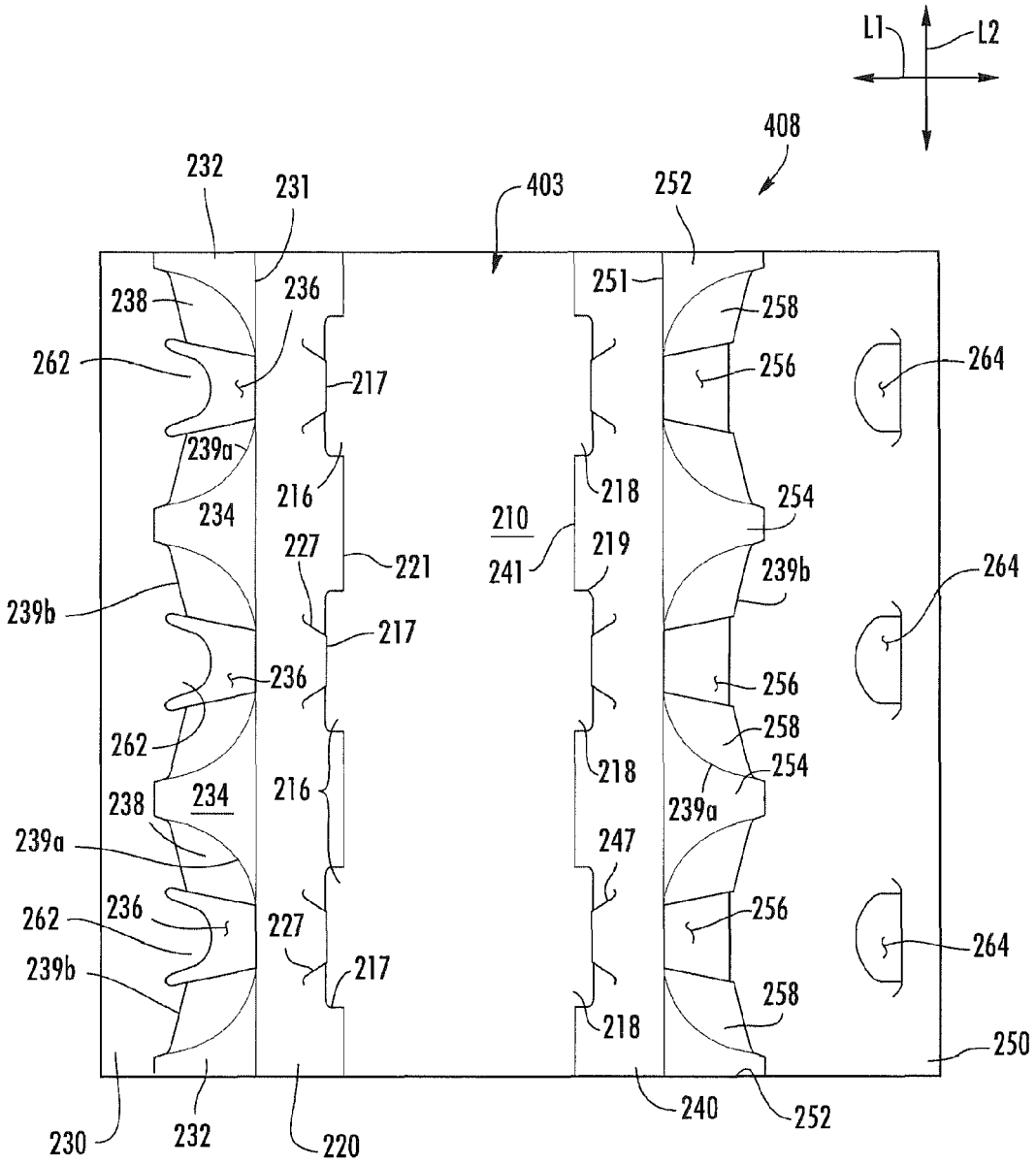
FIG. 13 is a plan view of a blank used to form a package according to a third embodiment of the disclosure.

FIG. 13 illustrates an exterior side 403 of a blank 408 for fanning a carton or carrier (not shown) according to a third embodiment of the disclosure. The third embodiment is generally similar to the second embodiment, except for variations noted and variations that will be apparent to one of ordinary skill in the art. As shown in FIG. 13, the blank 408 includes three container-receiving portions 212 arranged in a single row. Accordingly, the blank includes two first inner struts 234 between the first outer struts 232 and two second inner struts 254 between the second outer struts 252. Additionally, the first bottom panel 230 can include three locking flaps 262 adjacent the three openings 236, and the second bottom panel 250 can include three locking apertures 264 aligned with the locking flaps 262. The assembled carrier can retain three containers C2 in the respective container-receiving portions 212. The blank 408 could be alternatively shaped, arranged, and/or configured without departing from the scope of the present disclosure.

Figure 14:
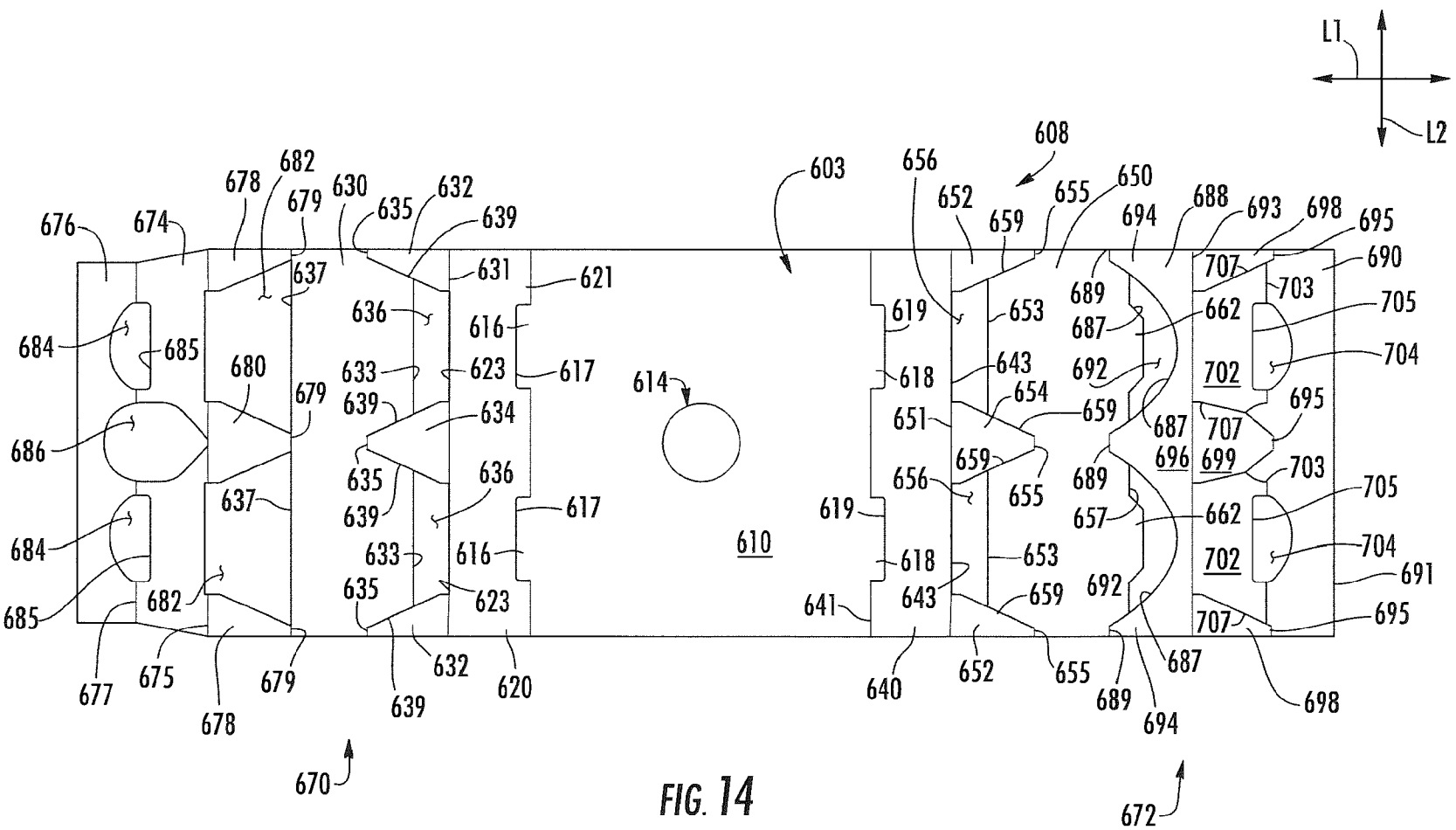
FIG. 14 is a plan view of a blank used to form a package according to a fourth embodiment of the disclosure.
Figure 18:
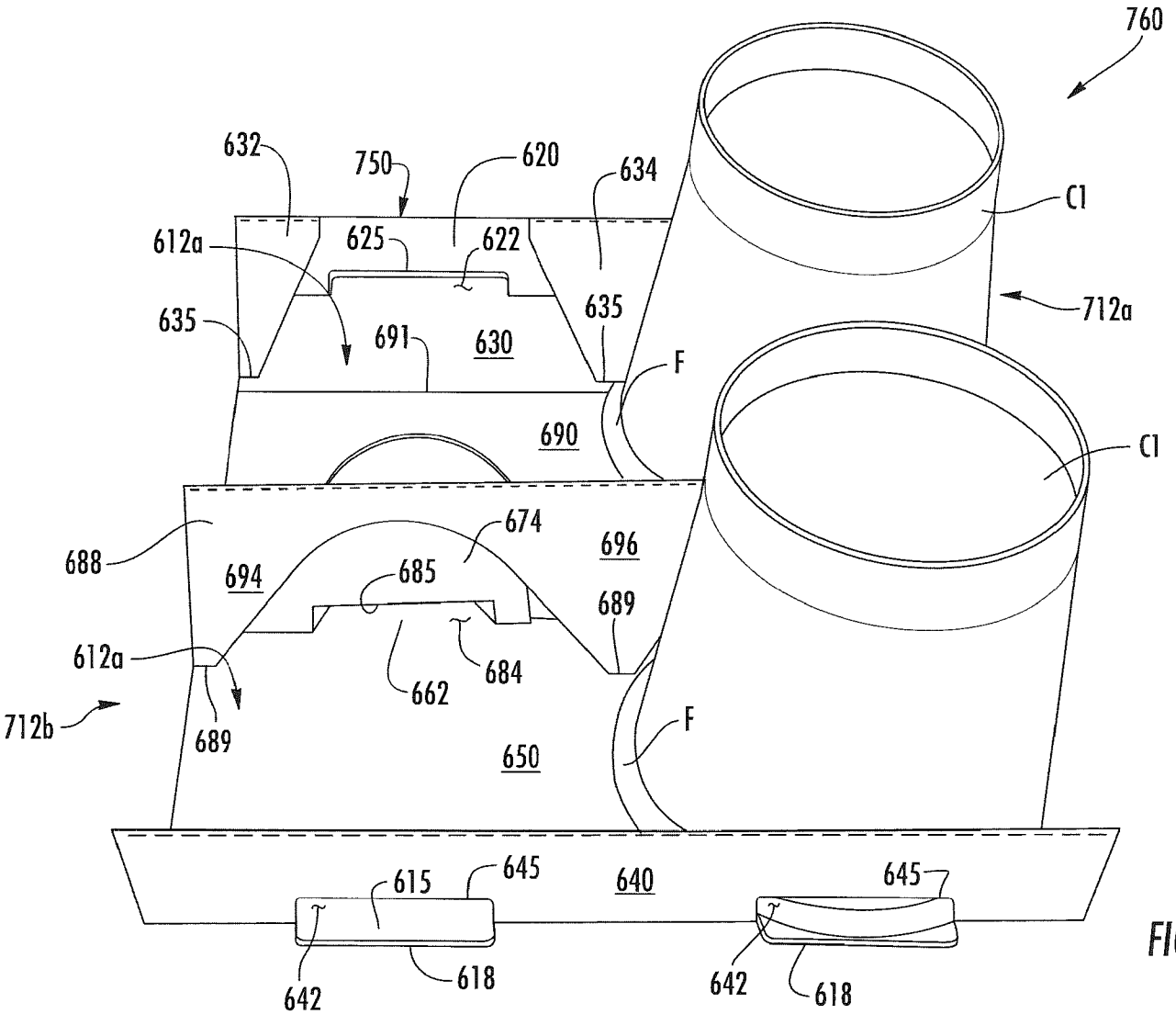
FIGS. 18 and 19 are bottom perspective views of the package of FIG. 17 with two containers omitted.
Figure 19:
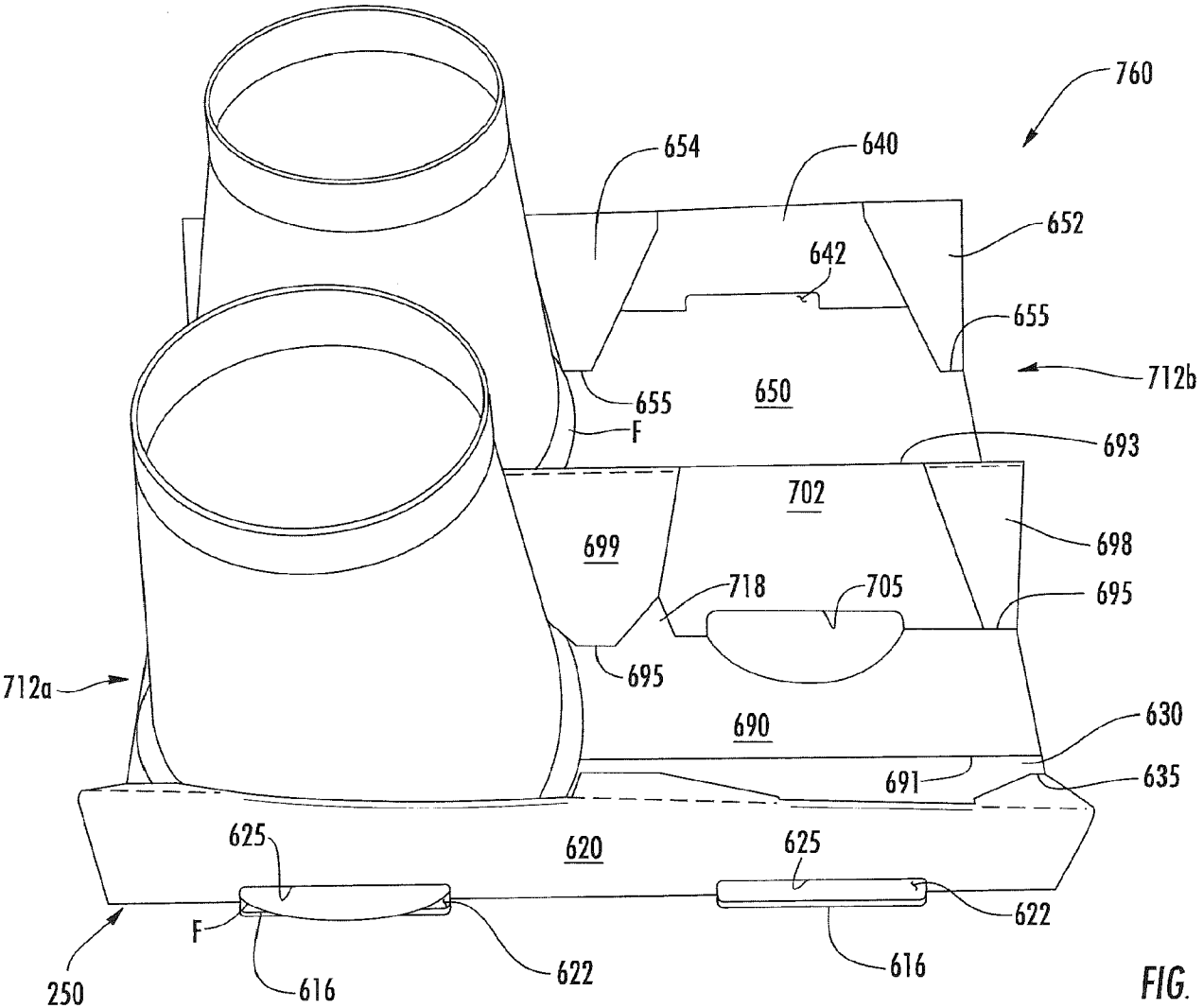

FIG. 14 illustrates an exterior side 603 of a blank 608 for forming a carton or carrier 750 according to a fourth embodiment of the disclosure. The fourth embodiment is generally similar to the first embodiment, except for variations noted and variations that will be apparent to one of ordinary skill in the art. The blank 608 has a longitudinal axis Li and a lateral axis L2. The carrier 750 is illustrated in its erected state in FIGS. 17-21, in which it is attached to upper portions of containers C1, forming a package 760. The containers C1, can be identical or similar to the containers C1 shown and described in the first embodiment above (e.g., with reference to FIGS. 3-6); however, other containers may be held in the package 760 without departing from the disclosure. In the exemplary embodiment, four containers C1 can be accommodated in the erected carrier 750, forming the 2×2 package 760. Other package configurations, such as 2×3, 2×4, or 2×1, etc. are also within the scope of the present disclosure. In FIGS. 18 and 19, only two containers C1 are accommodated in the four container-receiving portions 612 in order to show the interaction of the bottom structures in the erected carrier 750.

Referring to FIG. 14, the blank 608 comprises a top panel 610 foldably connected to a first side panel 620 at a first transverse fold line 621, a first bottom structure 670 foldably connected to the first side panel 620 at a second transverse fold line 631, a second side panel 640 foldably connected to the top panel 610 at a third transverse fold line 641, and a second bottom structure 672 foldably connected to the second side panel 640 at a fourth transverse fold line 651.

One or more cuts may be included in each of the transverse fold lines 621, 631, 641, 651 to facilitate folding along the fold lines. Any number of cuts may be formed in any of the fold lines, and the number and length of the cuts may be selected according to, for example, the gauge and/or the stiffness of the material used to form the blank 608. The fold lines 621, 631, 641, 651 may be formed by other methods (e.g., crease lines without cuts) without departing from the disclosure.

Figure 20:
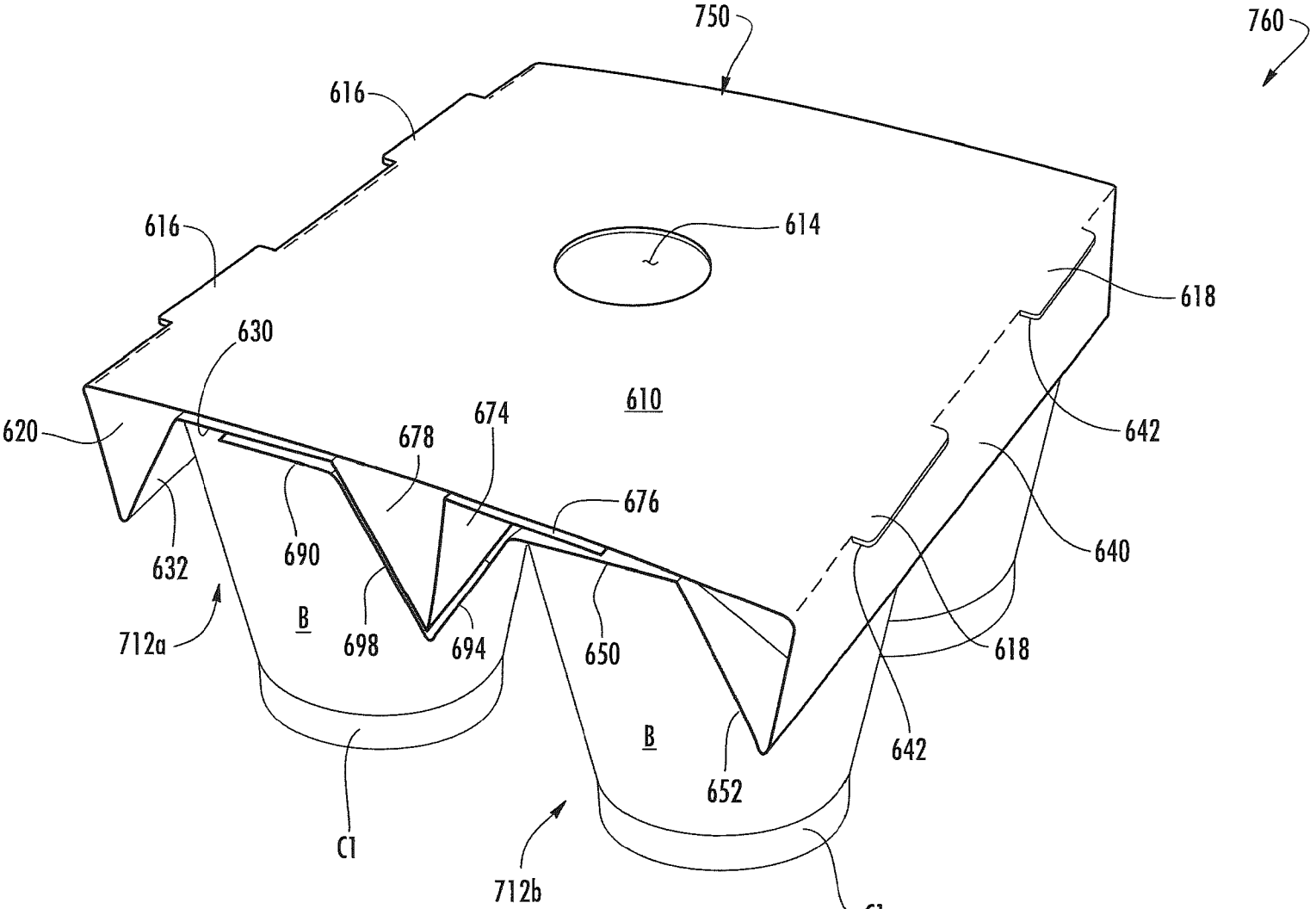
FIG. 20 is a top perspective view of the erected package according to the fourth embodiment of the disclosure.

In the illustrated embodiment, the blank 608 includes receiving features for forming the retention features in the carrier 750. The receiving features can include two first tabs 616 extending across the first transverse fold line 621 and two second tabs 618 extending across the third transverse fold line 641, opposite to the respective first tabs 616. The first tabs 616 are each defined by a tear line or cut line 617 extending in the top panel 610 and into the side panel 620. Similarly, the second tabs 618 are each defined by a tear line or cut line 619 extending in the top panel 610 and into the side panel 640. In the erected carrier, the tabs 616, 618 separate from the respective side panels 620, 640 at the respective cut lines 617, 619 to respectively form retaining features in the form of opposing side openings 622, 642 with respective bottom or retaining edges 625, 645 in the respective side panels 620, 640 (FIGS. 18-20). The top panel 610 further can include a finger hole 614 for carrying the package 760. Alternatively, the finger hole 624 can be omitted without departing from the scope of the disclosure.

In the illustrated embodiment, the first bottom structure 670 can include a first bottom panel 630, a first divider panel 674, and a first end panel 676. The first bottom panel 630 is connected to the first side panel 620 by two first outer struts 632 and a first inner strut 634. An opening 636 is defined between each first outer strut 632 and the first inner strut 634. The openings 636 can be further defined between a first edge 633 of the first bottom panel 630 and an inner edge 623 of the first side panel 620. The first struts 632, 634 are each foldably connected to the first side panel 620 at the transverse fold line 631 and to the first bottom panel 630 at the transverse fold lines 635. As shown in FIG. 14, the transverse fold lines 635 extend in the first bottom panel 630, spaced apart from the first edge 633 and a second edge 637 of the first bottom panel. The first struts 632, 634 are separable from the first bottom panel 630 along oblique cut lines 639. In an alternative embodiment, the cut lines 639 can be tear lines or another form of weakening. The first struts have a generally trapezoidal shape, wherein the fold lines 635 are shorter than the portion of the respective struts connected to the side panel 620 at fold line 631.

The first divider panel 674 can be connected to the first bottom panel 630 by two second outer struts 678 and a second inner strut 680. The second struts 678, 680 are generally aligned with and similarly or identically shaped as the respective first struts 632, 634. The second struts 678, 680 are foldably connected to the first bottom panel 630 at transverse fold lines 679 and the first divider panel 674 at transverse fold line 675. Openings 682 can be defined between the second struts 678, 680. The first end panel is foldably connected to the first divider panel at a transverse fold line 677, and a first divider opening 684 can be defined between the first end panel 676 and each of two retaining edges 685 of the first divider panel 674, interrupting the fold line 677. An opening 686 can also be defined in the first divider panel 674 and the first end panel 676.

As shown in FIG. 14, the second bottom structure 672 can include a second bottom panel 650, a second divider panel 688, and a second end panel 690. The second bottom panel 650 is connected to the second side panel 640 by two third outer struts 652 and a third inner strut 654. An opening 656 is defined between each third outer strut 652 and the third inner strut 654. The openings 656 can be further defined between an inner edge 653 of the second bottom panel 650 and an inner edge 643 of the second side panel 640. Each of the third outer struts 652 are further generally aligned with the respective first outer struts 632, and the third inner strut 654 is generally aligned with the first inner strut 634. The third struts 652, 654 are each foldably connected to the second side panel 640 at the transverse fold line 651 and to the second bottom panel 650 at transverse fold lines 655. As shown in FIG. 14, the transverse fold lines 655 extend in the second bottom panel 650, spaced apart from the inner edge 653 and an outer edge 657 of the first bottom panel. The third struts 652, 654 are separable from the second bottom panel 650 along oblique cut lines 659. In an alternative embodiment, the cut lines 659 can be tear lines or another form of weakening. The third struts have a generally trapezoidal shape, wherein the fold lines 655 are shorter than the portion of the respective struts connected to the side panel 640 at fold line 651.

The second divider panel 688 can include two arcuate edges 687 that form openings 692 between the second divider panel 688 and the second bottom panel 650. The arcuate edges 687 also form two outer strut portions 694 and an inner strut portion 696 of the second divider panel. The second divider panel 688 can be connected to the second bottom panel 650 by transverse fold lines 689. The strut portions 694, 696 are generally aligned with the respective third struts 652, 654. The second divider panel 688 can be connected to the second end panel 690 by two fourth outer struts 698 and a fourth inner strut 699. The fourth struts 698, 699 are foldably connected to the second divider panel 688 at a transverse fold line 693 and the second end panel 690 at transverse fold lines 695, which extend in the second end panel 690 and are spaced apart from the laterally-extending edges of the second end panel. Two divider flaps 702 can be foldably connected to the second divider panel 688 at the transverse fold line 693, and can extend to the second end panel 690 between the respective fourth outer struts 698 and the fourth inner strut 699. A second divider opening 704 can be defined between a retaining edge 705 of each of the divider flaps 702 and the second end panel 690. The divider flaps 702 can be further separated from the second end panel 690 along cut lines 703 or other forms of weakening Further, a cut line 707 can extend between each of the struts 698, 699 and the respective divider flaps 702. The divider flaps can be alternatively configured or omitted without departing from the scope of the present disclosure.

As shown in FIG. 14, two locking tabs 662 can extend from the second bottom panel 650 for engaging the first divider openings 684 in the first bottom structure 670 at the retaining edges 685 of the first divider panel 674. The engagement of the locking tabs 662 and the divider openings 684 helps to interlock the first and second bottom structures 670, 672 in the erected carrier 750.

In an alternative embodiment, more than one inner strut 634, 654, 680, 696, 699 can be included in each set of inner and outer struts. For example, an alternative carrier configured to hold six containers in two rows can include two inner struts disposed between each set of outer struts. In a further alternative, a carrier can be configured to hold two containers in a single row, and the inner struts can be omitted.

Figure 15:
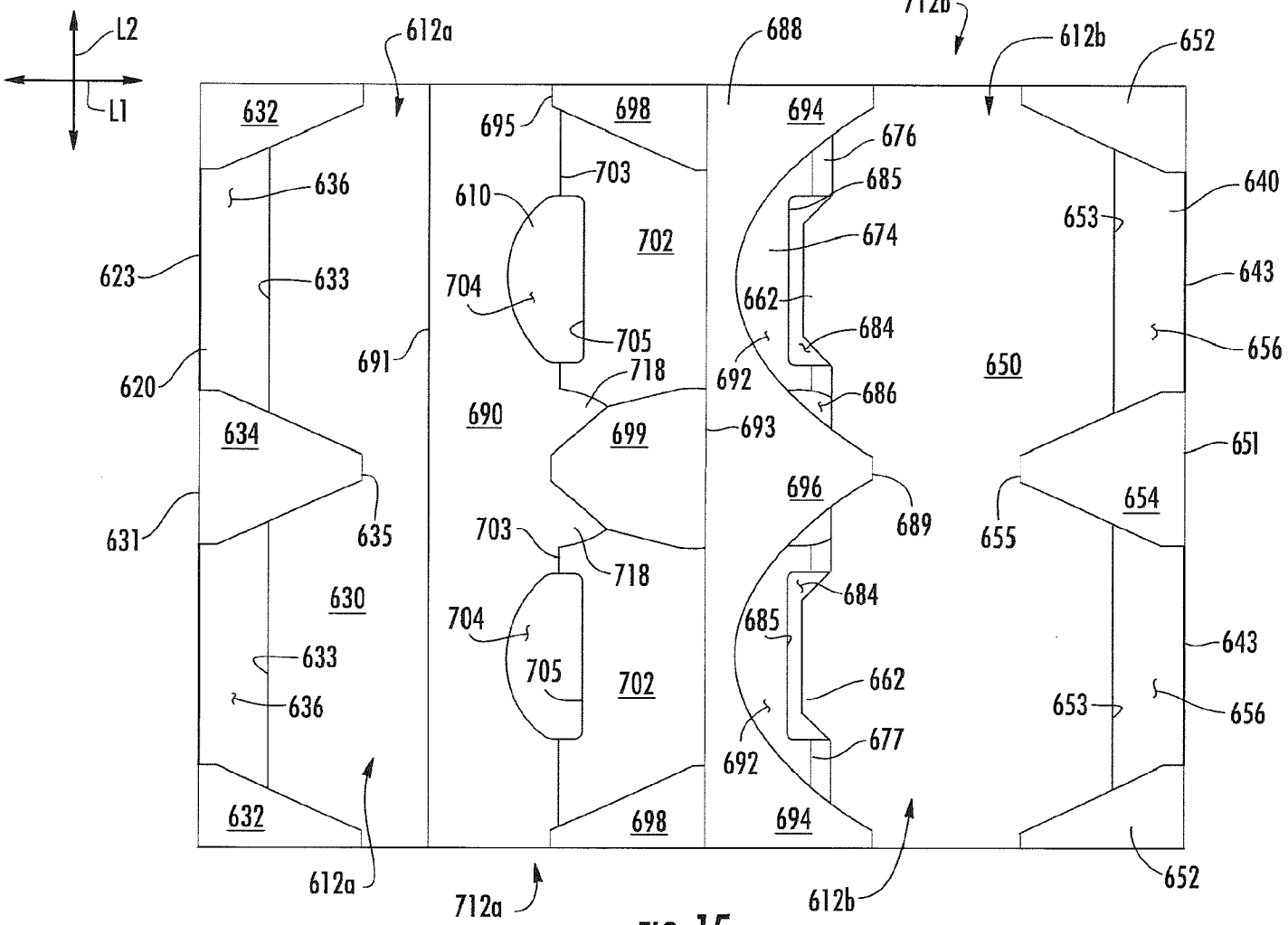
FIG. 15 is a plan view of a partially-formed package according to the fourth embodiment of the disclosure.

An exemplary method of erection of the carrier 750 to form the package 760 is discussed below with reference to FIGS. 15-19. In FIGS. 15-19, the blank 608 and the carrier 750 are disposed top-side down for forming the package 760 and for showing the features of the carrier 750. As shown in FIG. 15, the first bottom structure 670 is folded along the lateral fold line 631 so that the first bottom structure 670 generally overlaps and is in face-to-face contact with the top panel 610 and the first side panel 620. Similarly, the second bottom structure 672 is folded along the lateral fold line 651 so that the second bottom structure 672 generally overlaps the top panel 610, the second side panel 640, and the first bottom structure 670. In the illustrated embodiment, the second bottom panel 650 generally overlaps the first end panel 676, and the second end panel 690 generally overlaps the first bottom panel 630. A free edge 691 of the second end panel 690 overlays the first bottom panel 630 (FIG. 15). Also, the locking tabs 662 can be aligned with the divider openings 684 and the retaining edges 685 of the first divider panel 674, and the fourth struts 698, 699 can generally overlap the respective second struts 678, 680. Accordingly, the bottom structures 670, 672 form container-receiving portions 612*a*, 612*b* arranged in respective rows 712*a*, 712*b*.

Figure 16:
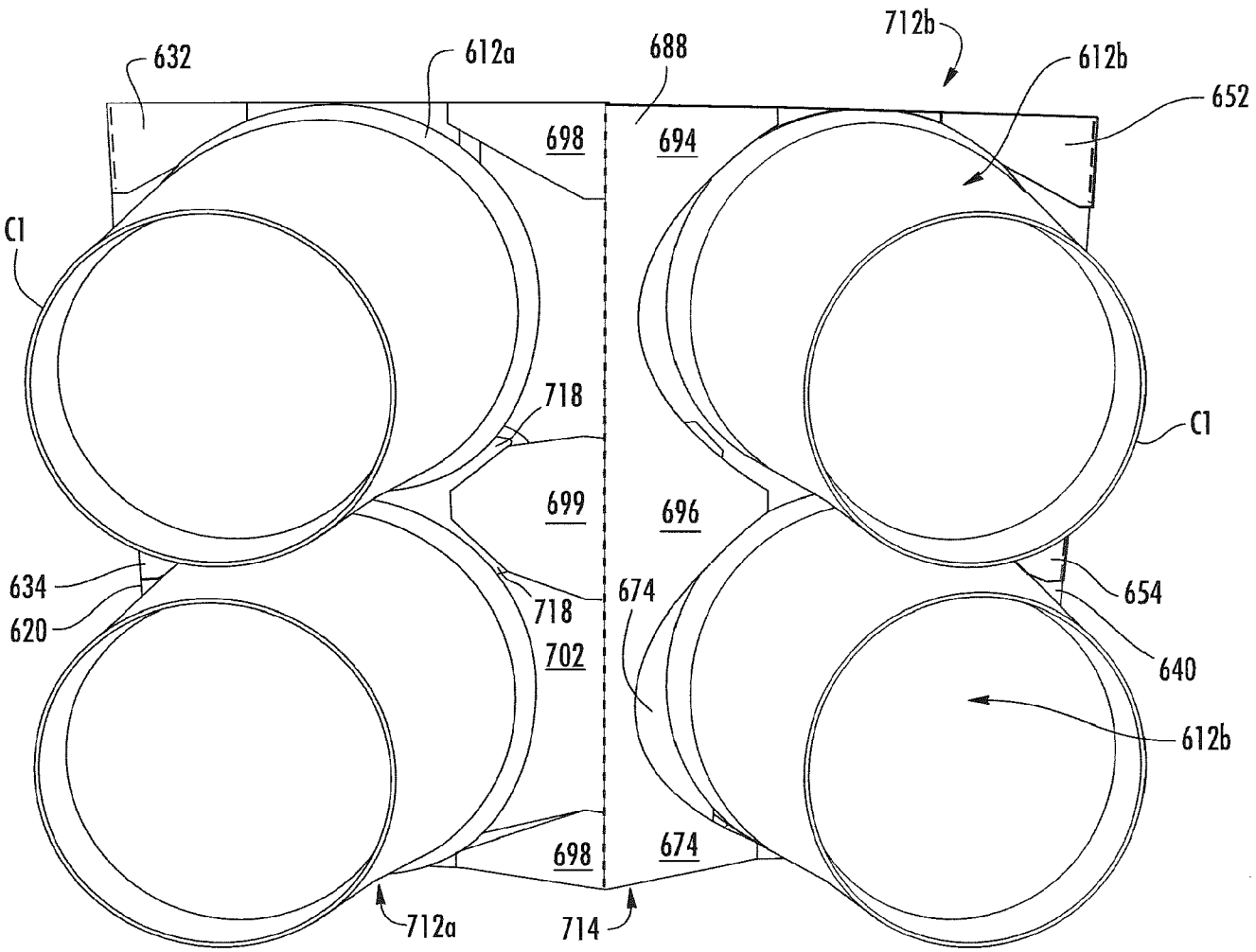
FIG. 16 is a bottom view of the partially-formed package of FIG. 15 with containers disposed thereon.

As shown in FIG. 16, a container C1 is placed on the bottom structures 670, 672 over each of the container-receiving portions 612*a*, 612*b*, between each outer strut 632, 652, 678, 694, 698 and respective inner strut 634, 654, 680, 696, 699. The side panels 620, 640 can be folded inwardly along respective fold lines 621, 641, causing the bottom structures 670, 672 to slide inwardly until the side panels 620, 640 are generally perpendicular to the top panel 610 (FIG. 17) and the bottom structures 670, 672 form a divider 714 extending between the first and second rows 712*a*, 712*b*. As the side panels 620, 640 fold inwardly, the struts 632, 634, 652, 654 separate from the respective bottom panels 630, 650 at the cut lines 639, 659 as the struts fold along respective fold lines 631, 635 and 651, 655 to extend between the bottom panels and the adjacent side panels. The folding of the side panels further forms the divider 714 in the bottom structures 670, 672 as the bottom panel 650 is pushed inwardly by the struts 652, 654, the locking tabs 662 engage the bottom edges 685 of the first divider panel 674 so that the divider panels 674, 688 fold along lateral fold lines 675, 693 and pivot away from the top panel 610 between the containers C1. As the divider 714 is formed, the strut portions 694, 696 of the second divider panel 688 separate from the second bottom panel 650, and the fourth struts 698, 699 separate from the second end panel 690. The second end panel 690 forms a generally wedge-shaped recess between two protuberances 718 when the fourth inner strut 699 separates from the end panel. The protuberances 718 engage the second inner strut 680 near the fold line 679 when the divider 714 is fowled. The divider flaps 702 can be pushed inwardly by the containers C1 or by a user as the divider 714 is formed so that the divider flaps extend generally vertically from the lateral fold line 693. The bottom structures 670, 672 can be otherwise arranged or can otherwise interact to form the divider 714 and the container-receiving portions 612*a*, 612*b* without departing from the scope of this disclosure.

Further, as the side panels 620, 640 fold inwardly, retaining features (e.g., the side openings 622, 642) are formed in the respective side panels 620, 640 adjacent the respective tabs 616, 618 extending from the top panel 610. As shown in FIGS. 18-21, the flange F of each container C1 in the first row 712*a* extends through one of the side openings 622, and the flange F of each container C1 in the second row 712*b* extends through one of the side openings 642. According to one embodiment, the side openings 622, 642 are disposed so that the respective retaining edges 625, 645 of the side openings force the flanges F of the containers upwardly.

Figure 17:
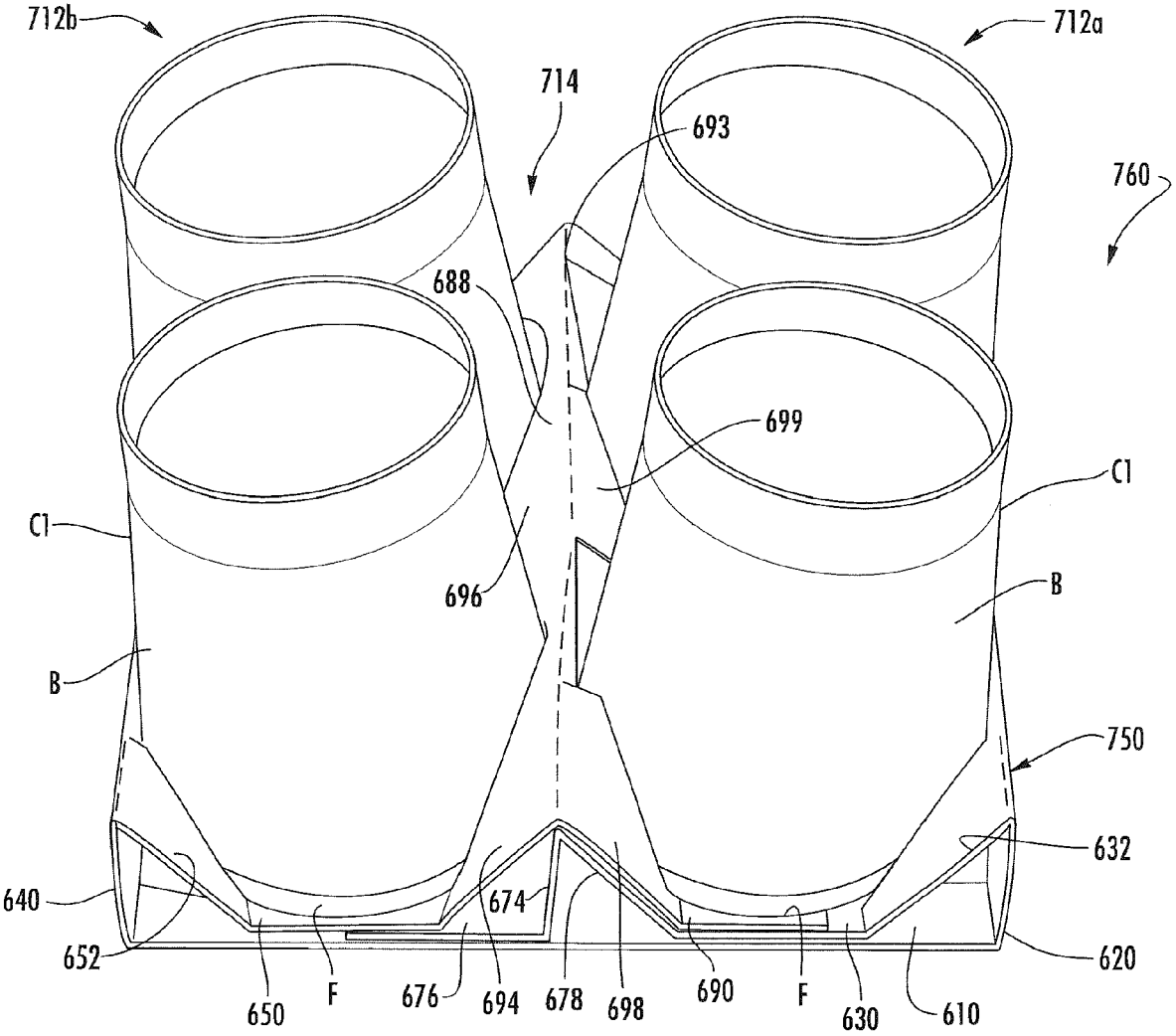
FIG. 17 is a bottom perspective view of the erected package according to the fourth embodiment of the disclosure.
Figure 21:
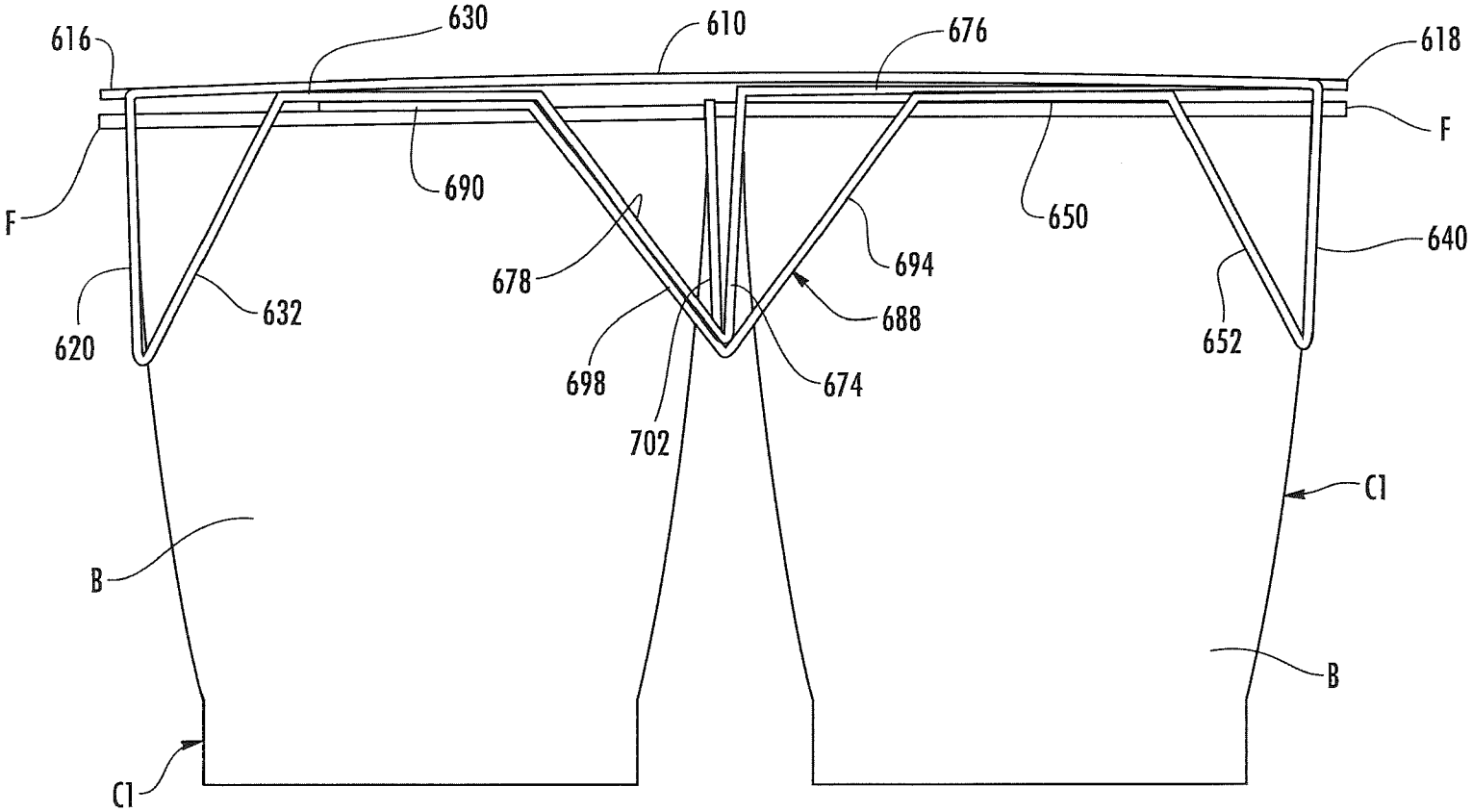
FIG. 21 is an end view of the package of FIG. 20.

The erected carrier 750 holding two containers C1 to faun the package 760 is shown in FIGS. 17 and 20. One container C1 is shown in each container-receiving portion 612*a*, and another container C1 is shown in each container-receiving portion 612*b*. As shown in FIG. 21, the flanges F of two adjacent containers C1 in the respective rows 712*a*, 712*b* can overlap. In the first container-receiving portion 612*a*, the flange F is retained against the second end panel 690 and the first bottom panel 630 by the retaining edge 625 of the side opening 622 in the first side 620 and the retaining edge 705 of one of the divider flaps 702. Accordingly, the openings 622, 704 and the retaining edges 625, 705 at least partially form the retaining features of the first container-receiving portion 612*a* (e.g., the openings 622 and the retaining edges 625 are outer retaining features, and the openings 704 and the retaining edges 705 are inner retaining features). The first struts 632, 634 can extend upwardly and obliquely from the first bottom panel 630 to the first side panel 620 on either side of the body B of the container C1 to help retain the position of the first side panel 620. The second struts 678, 680 can extend upwardly and obliquely from the first bottom panel 630 to the first divider panel 674, and the fourth struts 698, 699 can extend upwardly and obliquely from the second end panel 690 to the second diver panel 688 on either side of the body B of the container C1 to help retain the position of the divider 714.

In the second container-receiving portion 612*b*, the flange F is retained against the second bottom panel 650 and the first end panel 676 by the retaining edge 645 of the side opening 642 in the second side 640 and the retaining edge 685 of the divider panel 674. Accordingly, the openings 642, 684 and the retaining edges 645, 685 at least partially form the retaining features of the second container-receiving portion 612*b* (e.g., the openings 642 and the retaining edges 645 are outer retaining features, and the openings 684 and the retaining edges 685 are inner retaining features). In addition, or alternatively, the flange F of the container in one container-receiving portion 612*a* can overlap the flange F of the adjacent container-receiving portion 612*b* so that the retaining edge 705 of one of the divider flaps 702 retains two flanges F. Alternatively, flange of the container in the container-receiving portion 612*b* can be retained by the edge 705 of one of the divider flaps 702 directly. As shown in FIG. 21, the divider panel 674 and the divider flaps 702 can extend generally vertically or close to vertically between the top portion of the carrier 750 and the bottom portion of the divider 714. The third struts 652, 654 can extend upwardly and obliquely from the second bottom panel 650 to the second side panel 640 on either side of the body B of the container C1 to help retain the position of the second side panel 640. The strut portions 694, 696 of the second divider panel 688 can extend upwardly and obliquely from the second bottom panel 650 to the respective fourth struts 698, 699 on either side of the body B of the container C1 to help retain the position of the divider 714.

Accordingly, in the illustrated embodiment, the containers C1 can be retained in the carrier 750 without requiring adhesives or other fasteners. Instead, the containers C1 are supported at the flanges F by the retaining edges 625, 645 of the respective side openings 620, 640, the retaining edges 685 of the divider panel 674, and the bottom edges 705 of the divider flaps 702. The containers C1 can be retained at the bodies B by the side panels 620, 640 and the divider 714, which squeeze the bodies B therebetween. Any force tending to pull one or more of the containers C1 away from the carrier 750 can be resisted by one or more of the edges 625, 645, 685, 705 engaging the flanges F. Any force tending to pull one or both of the side panels 620, 640 away from the containers C1 is resisted by the respective bottom panels 630, 650 via the respective struts 632, 634 and 652, 654, wherein the bottom panels are retained between the flanges F and the top panel 610. Further, the positioning of the divider 714 is reinforced by the interaction of the locking tabs 662 with the edges of the first divider panel 674 at the openings 684 and the protuberances 718 of the second end panel 690 with the second inner strut 680.

The top panel 610, the side panels 620, 640, and the bottom structures 670, 672 can be otherwise arranged or interconnected, and the container-receiving portions 612*a*, 612*b* and the divider 714 can be alternatively famed without departing from the scope of this disclosure. Further, the containers C1 can be alternatively inserted into and retained by the container-receiving portions 612*a*, 612*b* without departing from this disclosure. For example, two containers C1 can be inserted first, one into a container-receiving portion 612*a* and one into an adjacent container-receiving portion 612*b*, and two additional containers C1 can be inserted subsequently. Alternatively, all containers C1 can be inserted into respective container-receiving portions 612*a*, 612*b* at the same time.

In the illustrated embodiment, the carrier 750 is open-ended, and the side panels 620, 640 extend generally downwardly from the top panel 610. The side panels can also at least partially conform to the shape of the containers C1. A user can easily grasp the carrier 750 at the finger hole 614 and at the bottom edges of the side panels 620, 640 or at the open ends in order to carrier the package 760. In an alternative embodiment, one or more end panels can be foldably connected to one or more of the top panel 610, the side panels 620, 640, and the bottom panels 630, 650.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package comprising a carrier at least partially holding a plurality of containers, each container of the plurality of containers comprising a rim portion and a body portion, the carrier comprising:

a top panel, a first side panel foldably connected to the top panel, a second side panel foldably connected to the top panel, a first bottom panel connected to the first side panel by at least one first strut, and a second bottom panel connected to the second side panel by at least one second strut, wherein at least a portion of each of the top panel, the first side panel, and the second side panel extends along at least a portion of an end of the carrier; and at least one first container receiver in a first row and at least one second container receiver in a second row, the plurality of containers comprising at least one first container at least partially retained by the at least one first container receiver in the first row and at least one second container at least partially retained by the at least one second container receiver in the second row, each of the at least one first container receiver and the at least one second container receiver comprising a first retaining feature and an opposing second retaining feature, at least a portion of at least one of the first retaining features and the second retaining features being disposed in the first side panel or the second side panel, the rim portions of each of the at least one first container and the at least one second container being at least partially retained by at least one of the respective first retaining features and the respective second retaining features;

wherein at least a portion of at least one of the first bottom panel and the second bottom panel is at least partially disposed between a top portion of the at least one container and the top panel, and each of the at least one first container and the at least one second container is retained by the respective at least one first container receiver and second container receiver adjacent the end of the carrier.

2. The package of claim 1, further comprising a first bottom structure comprising at least the first bottom panel and a second bottom structure comprising at least the second bottom panel.

3. The package of claim 2, wherein the respective first retaining feature of the at least one first container receiver and the at least one second container receiver comprises a respective first outer retaining feature and second outer retaining feature, and the respective second retaining feature of the at least one first container receiver and the at least one second container receiver comprises a respective first inner retaining feature and second inner retaining feature.

4. The package of claim 3, wherein the first inner retaining feature comprises a first inner retaining edge in the first bottom structure and the second inner retaining feature comprises a second inner retaining edge in the second bottom structure.

5. The package of claim 4, wherein the first outer retaining feature comprises a first outer retaining edge in the first side panel, and the second outer retaining feature comprises a second outer retaining edge in the second side panel, the first outer retaining edge being aligned with the first inner retaining edge, and the second outer retaining edge being aligned with the second inner retaining edge.

6. A package comprising a carrier at least partially holding a plurality of containers, each container of the plurality of containers comprising a rim portion and a body portion, the carrier comprising:

a top panel, a first side panel foldably connected to the top panel, a second side panel foldably connected to the top panel, a first bottom panel connected to the first side panel by at least one first strut, and a second bottom panel connected to the second side panel by at least one second strut;

a first bottom structure comprising at least the first bottom panel and a second bottom structure comprising at least the second bottom panel, wherein the first bottom structure further comprises a first divider panel and a first end panel, and the second bottom structure further comprises a second divider panel and a second end panel; and at least one first container receiver in a first row and at least one second container receiver in a second row, the plurality of containers comprising at least one first container at least partially retained by the at least one first container receiver in the first row and at least one second container at least partially retained by the at least one second container receiver in the second row, each of the at least one first container receiver and the at least one second container receiver comprising a first retaining feature and an opposing second retaining feature, at least a portion of at least one of the first retaining features and the second retaining features being disposed in the first side panel or the second side panel, the rim portions of each of the at least one first container and the at least one second container being at least partially retained by at least one of the respective first retaining features and the respective second retaining features;

wherein at least a portion of at least one of the first bottom panel and the second bottom panel is at least partially disposed between a top portion of the at least one container and the top panel.

7. The package of claim 6, wherein the first bottom panel at least partially overlaps the second end panel, the first divider panel at least partially overlaps the second divider panel, and the first end panel at least partially overlaps the second bottom panel.

8. The package of claim 7, wherein the second bottom panel comprises at least one locking tab and the first divider panel comprises at least one locking aperture, the at least one locking tab at least partially engaging the at least one locking aperture.

9. The package of claim 8, wherein the second divider panel comprises at least one divider opening, and the at least one locking tab is adjacent the at least one divider opening.

10. The package of claim 8, wherein the second retaining feature of the at least one second container receiver comprises a retaining edge adjacent the rim portion of the at least one container, the retaining edge being adjacent the locking aperture in the first divider panel.

11. The package of claim 6, wherein the first end panel is foldably connected to the first divider panel, the first divider panel is connected to the first bottom panel by at least one third strut, the second divider panel is foldably connected to the second bottom panel, and the second end panel is connected to the second divider panel by at least one fourth strut.

12. The package of claim 11, wherein the first bottom panel at least partially overlaps the second end panel, the first divider panel at least partially overlaps the second divider panel, the at least one third strut generally overlaps the at least one fourth strut, and the first end panel at least partially overlaps the second bottom panel.

13. The package of claim 12, wherein:

each of the at least one third strut and the at least one fourth strut is oblique with respect to the top panel;

at least the second divider panel is oblique with respect to the top panel; and the at least one third strut is foldably connected to the first divider panel along at least one first divider fold line, and the at least one fourth strut is foldably connected to the second divider panel along at least one second divider fold line, the at least one first divider fold line and the at least one second divider fold line being spaced apart from the top panel, being generally lateral, and extending between the first row and the second row.

14. The package of claim 11, wherein:

the second bottom structure comprises at least one divider flap foldably connected to the second divider panel, at least a portion of the at least one divider flap being disposed adjacent the at least one fourth strut;

the respective first retaining feature of the at least one first container receiver and the at least one second container receiver comprises a respective first outer retaining feature and second outer retaining feature, and the respective second retaining feature of the at least one first container receiver and the at least one second container receiver comprises a respective first inner retaining feature and second inner retaining feature; and the first inner retaining feature comprises a first inner retaining edge in the at least one divider flap, and the first outer retaining feature comprises a first outer retaining edge in the first side panel, each of the first inner retaining edge and the first outer retaining edge at least partially receiving a respective portion of the rim portion of the at least one first container.

15. The package of claim 14, wherein the second inner retaining feature comprises a second inner retaining edge in the first divider panel, and the second outer retaining feature comprises a second outer retaining edge in the second side panel, each of the second inner retaining edge and the second outer retaining edge at least partially receiving a respective portion of the rim portion of the at least one second container.

16. The package of claim 11, wherein the at least one first strut comprises at least two first struts, the at least one second strut comprises at least two second struts, the at least one third strut comprises at least two third struts, and the at least one fourth strut comprises at least two fourth struts.

17. The package of claim 16, wherein each of the at least two first struts, the at least two third struts, and the at least two fourth struts comprises an oblique edge adjacent the at least one first container.

18. The package of claim 16, wherein each of the at least two second struts comprises an oblique edge adjacent the at least one second container, and the second divider panel comprises at least one arcuate edge that is generally aligned with the at least one second inner retaining feature and is adjacent the at least one second container.

19. The package of claim 6, wherein:

each of the first bottom panel and the second bottom panel comprises two lateral edges; and the at least one first strut is foldably connected to the first bottom panel along a first lateral fold line, and the at least one second strut is foldably connected to the second bottom panel along a second lateral fold line, each of the first lateral fold line and the second lateral fold line being respectively spaced apart from the two lateral edges of each of the respective first bottom panel and second bottom panel.

20. The package of claim 19, wherein the second divider panel is foldably connected to the second bottom panel along at least two third lateral fold lines, the at least two third lateral fold lines being spaced apart from the two lateral edges of the second bottom panel.

21. A blank for forming a carrier for at least partially holding a plurality of containers, each container of the plurality of containers comprising a rim portion and a body portion, the blank comprising:

a top panel, a first side panel foldably connected to the top panel, a second side panel foldably connected to the top panel, a first bottom panel connected to the first side panel by at least one first strut, and a second bottom panel connected to the second side panel by at least one second strut, wherein at least a portion of each of the top panel, the first side panel, and the second side panel extends along a marginal portion of the blank, the marginal portion being for at least partially forming an end of the carrier formed from the blank; and receiving features for forming at least one first container receiver in a first row and at least one second container receiver in a second row in the carrier formed from the blank, the plurality of containers comprising at least one first container for being at least partially retained by the at least one first container receiver in the first row in the carrier formed from the blank and at least one second container for being at least partially retained by the at least one second container receiver in the second row in the carrier formed from the blank, each of the at least one first container receiver and the at least one second container receiver comprising a first retaining feature and an opposing second retaining feature in the carrier formed from the blank, at least a portion of at least one of the first retaining features and the second retaining features for being disposed in the first side panel or the second side panel in the carrier formed from the blank, at least one of the first retaining features and the second retaining features being for at least partially retaining the respective rim portion of the at least one first container and the at least one second container in the carrier formed from the blank;

wherein at least a portion of at least one of the first bottom panel and the second bottom panel is for being at least partially disposed between a top portion of the at least one container and the top panel when the carrier is formed from the blank, and each of the at least one first container and the at least one second container is for being retained by the respective at least one first container receiver and second container receiver adjacent the end of the carrier formed from the blank.

22. The blank of claim 21, further comprising a first bottom structure comprising at least the first bottom panel and a second bottom structure comprising at least the second bottom panel.

23. The blank of claim 22, wherein the first bottom structure comprises a first inner retaining edge in, the second bottom structure comprises a second inner retaining edge, the first side panel comprises a first outer retaining edge, and the second side panel comprises a second outer retaining edge, the first outer retaining edge being aligned with the first inner retaining edge, and the second outer retaining edge being aligned with the second inner retaining edge.

24. A blank for forming a carrier for at least partially holding a plurality of containers, each container of the plurality of containers comprising a rim portion and a body portion, the blank comprising:

a top panel, a first side panel foldably connected to the top panel, a second side panel foldably connected to the top panel, a first bottom panel connected to the first side panel by at least one first strut, and a second bottom panel connected to the second side panel by at least one second strut;

a first bottom structure comprising at least the first bottom panel and a second bottom structure comprising at least the second bottom panel, wherein the first bottom structure further comprises a first divider panel and a first end panel, and the second bottom structure further comprises a second divider panel and a second end panel; and receiving features for forming at least one first container receiver in a first row and at least one second container receiver in a second row in the carrier formed from the blank, the plurality of containers comprising at least one first container for being at least partially retained by the at least one first container receiver in the first row in the carrier formed from the blank and at least one second container for being at least partially retained by the at least one second container receiver in the second row in the carrier formed from the blank, each of the at least one first container receiver and the at least one second container receiver comprising a first retaining feature and an opposing second retaining feature in the carrier formed from the blank, at least a portion of at least one of the first retaining features and the second retaining features for being disposed in the first side panel or the second side panel in the carrier formed from the blank, at least one of the first retaining features and the second retaining features being for at least partially retaining the respective rim portion of the at least one first container and the at least one second container in the carrier formed from the blank;

wherein at least a portion of at least one of the first bottom panel and the second bottom panel is for being at least partially disposed between a top portion of the at least one container and the top panel when the carrier is formed from the blank.

25. The blank of claim 24, wherein, when the carrier is formed from the blank, the first bottom panel is for at least partially overlapping the second end panel, the first divider panel is for at least partially overlapping the second divider panel, and the first end panel is for at least partially overlapping the second bottom panel.

26. The blank of claim 25, wherein the second bottom panel comprises at least one locking tab and the first divider panel comprises at least one locking aperture, the at least one locking tab being for at least partially engaging the at least one locking aperture when the carrier is formed from the blank.

27. The blank of claim 26, wherein the second divider panel comprises at least one divider opening, and the at least one locking tab is adjacent the at least one divider opening.

28. The blank of claim 26, wherein the first divider panel comprises a retaining edge adjacent the locking aperture, and the retaining edge is for being disposed adjacent the rim portion of the at least one container in the carrier formed from the blank.

29. The blank of claim 24, wherein the first end panel is foldably connected to the first divider panel, the first divider panel is connected to the first bottom panel by at least one third strut, the second divider panel is foldably connected to the second bottom panel, and the second end panel is connected to the second divider panel by at least one fourth strut.

30. The blank of claim 29, wherein the at least one third strut is foldably connected to the first bottom panel along at least one first divider fold line, the at least one third strut is foldably connected to the first divider panel along at least one second divider fold line, the at least one fourth strut is foldably connected to the second bottom panel along at least one third divider fold line, and the at least one fourth strut is foldably connected to the second divider panel along at least one fourth divider fold line.

31. The blank of claim 29, wherein:

the second bottom structure comprises at least one divider flap foldably connected to the second divider panel, at least a portion of the at least one divider flap being disposed adjacent the at least one fourth strut; and the at least one divider flap comprises a first retaining edge and the first side panel comprises at least one first cut line for forming a second retaining edge in the carrier formed from the blank, the receiving features being for forming at least a portion of the at least one first container receiver from the first retaining edge and the second retaining edge in the carrier formed from the blank.

32. The blank of claim 31, wherein the first divider panel comprises a third retaining edge and the second side panel comprises at least one second cut line for forming a fourth retaining edge in the carrier formed from the blank, the receiving features being for forming at least a portion of the at least one second container receiver from the third retaining edge and the fourth retaining edge in the carrier formed from the blank.

33. The blank of claim 29, wherein:

the at least one first strut comprises at least two first struts, the at least one second strut comprises at least two second struts, the at least one third strut comprises at least two third struts, and the at least one fourth strut comprises at least two fourth struts;

each of the at least two first struts, the at least two third struts, and the at least two fourth struts comprises an oblique edge for being disposed adjacent the at least one first container; and each of the at least two second struts comprises an oblique edge for being disposed adjacent the at least one second container.

34. The blank of claim 24, wherein the second divider panel comprises at least one arcuate edge that is for being disposed adjacent the at least one second container.

35. The blank of claim 24, wherein:

each of the first bottom panel and the second bottom panel comprises two lateral edges; and the at least one first strut is foldably connected to the first bottom panel along a first lateral fold line, and the at least one second strut is foldably connected to the second bottom panel along a second lateral fold line, each of the first lateral fold line and the second lateral fold line being respectively spaced apart from the two lateral edges of each of the respective first bottom panel and second bottom panel.

36. The blank of claim 35, wherein the second divider panel is foldably connected to the second bottom panel along at least two third lateral fold lines, the at least two third lateral fold lines being spaced apart from the two lateral edges of the second bottom panel.

37. A method of forming a package, comprising:

obtaining a blank comprising a top panel, a first side panel foldably connected to the top panel, a second side panel foldably connected to the top panel, a first bottom panel connected to the first side panel by at least one first strut, and a second bottom panel connected to the second side panel by at least one second strut;

positioning the first bottom panel and the second bottom panel to be at least partially overlapped by the top panel;

positioning at least one first container so that at least a portion of at least the first bottom panel is at least partially disposed between a top portion of the at least one first container and the top panel and positioning at least one second container so that at least a portion of at least the second bottom panel is at least partially disposed between a top portion of the at least one second container and the top panel; and forming at least one first container receiver in a first row and at least one second container receiver in a second row by folding at least one of the first side panel and the second side panel inwardly and forming a first retaining feature and an opposing second retaining feature so that a rim portion of each of the at least one first container and the at least one second container is at least partially retained by at least one of the first retaining feature and the second retaining feature, wherein at least a portion of at least one of the first retaining feature and the second retaining feature is disposed in the first side panel or the second side panel;

wherein at least a portion of each of the top panel, the first side panel, and the second side panel extends along at least a portion of an end of the carrier, and each of the at least one first container and the at least one second container is retained by the respective at least one first container receiver and second container receiver adjacent the end of the carrier.

38. A method of forming a package, comprising:

obtaining a blank comprising a top panel, a first side panel foldably connected to the top panel a second side panel foldably connected to the toe panel a first bottom panel connected to the first side panel by at least one first strut, a second bottom panel connected to the second side panel by at least one second strut, a first bottom structure and a second bottom structure, the first bottom structure comprising the first bottom panel, a first divider panel, and a first end panel, the second bottom structure comprising the second bottom panel, a second divider panel, and a second end panel;

positioning the first bottom panel and the second bottom panel to be at least partially overlapped by the top panel;

positioning at least one first container so that at least a portion of at least the first bottom panel is at least partially disposed between a top portion of the at least one first container and the top panel and positioning at least one second container so that at least a portion of at least the second bottom panel is at least partially disposed between a top portion of the at least one second container and the top panel;

forming at least one first container receiver in a first row and at least one second container receiver in a second row by folding at least one of the first side panel and the second side panel inwardly and forming a first retaining feature and an opposing second retaining feature so that a rim portion of each of the at least one first container and the at least one second container is at least partially retained by at least one of the first retaining feature and the second retaining feature, wherein at least a portion of at least one of the first retaining feature and the second retaining feature is disposed in the first side panel or the second side panel; and forming a divider comprising at least a portion of the first bottom structure and at least a portion of the second bottom structure, the divider being at least partially disposed between the first row and the second row.

39. The method of claim 38, wherein:

the forming the respective first retaining feature of the at least one first container receiver and the at least one second container receiver comprises forming a respective first outer retaining feature in at least the first side panel and second outer retaining feature in at least the second side panel; and the forming the respective second retaining feature of the at least one first container receiver and the at least one second container receiver comprises forming a respective first inner retaining feature in at least a portion of the divider and second inner retaining feature in at least a portion of the divider.

40. The method of claim 38, wherein:

the first end panel is foldably connected to the first divider panel, the first divider panel is connected to the first bottom panel by at least one third strut, the second divider panel is foldably connected to the second bottom panel, and the second end panel is connected to the second divider panel by at least one fourth strut, the first divider panel being foldably connected to the at least one third strut along at least one first divider fold line, and the second divider panel being foldably connected to the at least one fourth strut along at least one second divider fold line; and the forming the divider further comprises positioning the first divider panel to extend downwardly from the first end panel to the first divider fold line, positioning the at least one third strut to extend downwardly and obliquely from the first bottom panel to the first divider fold line, positioning the second divider panel to extend downwardly and obliquely from the second bottom panel to the second divider fold line, and positioning the at least one fourth strut to extend downwardly and obliquely from the second end panel to the second divider fold line.

* * * * *